US010501102B2

(12) United States Patent
Chung et al.

(10) Patent No.: US 10,501,102 B2
(45) Date of Patent: Dec. 10, 2019

(54) POSITIVE TRAIN CONTROL SYSTEM AND APPARATUS EMPLOYING RFID DEVICES

(71) Applicant: Avante International Technology, Inc., Princeton Junction, NJ (US)

(72) Inventors: Kevin Kwong-Tai Chung, Princeton, NJ (US); Albert Han-Ping Chung, Princton, NJ (US); Yulin Huang, East Windsor, NJ (US)

(73) Assignee: Avante International Technology, Inc., Princeton Junction, NJ (US)

( * ) Notice: Subject to any disclaimer, the term of this patent is extended or adjusted under 35 U.S.C. 154(b) by 210 days.

(21) Appl. No.: 15/835,085

(22) Filed: Dec. 7, 2017

(65) Prior Publication Data

US 2018/0222505 A1 Aug. 9, 2018

Related U.S. Application Data

(60) Provisional application No. 62/499,863, filed on Feb. 6, 2017.

(51) Int. Cl.
*B61L 27/00* (2006.01)
*B61L 27/04* (2006.01)
(Continued)

(52) U.S. Cl.
CPC ..... *B61L 27/0038* (2013.01); *B61L 3/125* (2013.01); *B61L 15/0027* (2013.01);
(Continued)

(58) Field of Classification Search
CPC .. B61L 27/0038; B61L 3/125; B61L 15/0027; B61L 25/025; B61L 27/04; B61L 2201/00; B61L 2205/04
See application file for complete search history.

(56) References Cited

U.S. PATENT DOCUMENTS 3,857,183 A 12/1974 Plasser et al.
4,235,112 A 11/1980 Kaiser
(Continued)

FOREIGN PATENT DOCUMENTS

CN 102514601 6/2012
DE 102006007788 8/2007
(Continued)

OTHER PUBLICATIONS

International Searching Authority/U.S., "International Search Report and Written Opinion" International Application No. PCT/US2018/016478, dated Apr. 23, 2018, 8 pgs.
(Continued)

*Primary Examiner* — Calvin Cheung
(74) *Attorney, Agent, or Firm* — Clement A. Berard, Esq.; Dann, Dorfman, Herrell & Skillman, PC

(57) ABSTRACT

A positive train control system and method comprises a plurality of RFID devices embedded in a track way and having data representing location stored therein, and an RFID reader/detector mounted on a train for reading the location data from the embedded RFID devices. The location data is processed on the train and/or at a central facility for determining whether the train location and/or time is consistent with a train routing order. Messages, alerts and/or warnings may be generated for an alert device and/or for automated response, e.g., via a train control system.

61 Claims, 10 Drawing Sheets

(51) Int. Cl.
*B61L 3/12* (2006.01)
*B61L 15/00* (2006.01)
*B61L 25/02* (2006.01)

(52) U.S. Cl.
CPC ..... *B61L 25/025* (2013.01); *B61L 27/04* (2013.01); *B61L 2201/00* (2013.01); *B61L 2205/04* (2013.01)

(56) References Cited

U.S. PATENT DOCUMENTS

| | | | | |
|---|---|---|---|---|
| 5,253,830 | A * | 10/1993 | Nayer | B61L 5/107 246/162 |
| 5,529,267 | A * | 6/1996 | Giras | B61L 1/06 246/120 |
| 5,978,718 | A | 11/1999 | Kull | |
| 6,657,543 | B1 | 12/2003 | Chung | |
| 6,694,045 | B2 | 2/2004 | Chung et al. | |
| 6,883,710 | B2 | 4/2005 | Chung | |
| 6,961,000 | B2 | 11/2005 | Chung | |
| 6,973,581 | B2 | 12/2005 | Chung et al. | |
| 7,036,729 | B2 | 5/2006 | Chung | |
| 7,098,793 | B2 | 8/2006 | Chung | |
| 7,319,397 | B2 | 1/2008 | Chung et al. | |
| 7,342,497 | B2 * | 3/2008 | Chung | G06Q 10/08 235/375 |
| 7,423,535 | B2 | 9/2008 | Chung et al. | |
| 7,436,989 | B2 | 10/2008 | Chung et al. | |
| 7,508,308 | B2 | 3/2009 | Chung | |
| 7,513,425 | B2 | 4/2009 | Chung | |
| 7,577,502 | B1 | 8/2009 | Henry | |
| 7,813,934 | B1 | 10/2010 | Chung | |
| 7,839,289 | B2 | 11/2010 | Chung et al. | |
| 7,894,634 | B2 | 2/2011 | Chung | |
| 8,174,383 | B1 | 5/2012 | Chung et al. | |
| 8,231,270 | B2 * | 7/2012 | Groeneweg | B61L 23/042 374/141 |
| 8,686,861 | B2 | 4/2014 | Chung et al. | |
| 9,286,511 | B2 | 3/2016 | Chung et al. | |
| 9,384,518 | B2 | 7/2016 | Chung | |
| 9,434,397 | B2 * | 9/2016 | Chung | B61L 25/025 |
| 9,542,597 | B2 | 1/2017 | Chung et al. | |
| 9,830,674 | B2 | 11/2017 | Chung | |
| 2002/0010531 | A1 | 1/2002 | Hawthorne et al. | |
| 2005/0125113 | A1 | 6/2005 | Wheeler | |
| 2007/0162199 | A1 | 7/2007 | Katsuta et al. | |
| 2007/0217670 | A1 | 9/2007 | Bar-Am | |
| 2008/0303656 | A1 | 12/2008 | Matthews, Jr. et al. | |
| 2010/0088914 | A1 | 4/2010 | Cerwin | |
| 2012/0018591 | A1 | 1/2012 | Ghaly | |
| 2013/0297199 | A1 | 11/2013 | Kapp et al. | |
| 2015/0009331 | A1 * | 1/2015 | Venkatraman | B61L 23/041 348/148 |
| 2016/0016597 | A1 | 1/2016 | Morris | |
| 2016/0046308 | A1 | 2/2016 | Chung et al. | |
| 2016/0339934 | A1 | 11/2016 | Chung et al. | |
| 2017/0043797 | A1 * | 2/2017 | Allshouse | B61L 25/025 |
| 2017/0124836 | A1 | 5/2017 | Chung et al. | |
| 2017/0278159 | A1 | 9/2017 | Chung | |
| 2017/0349194 | A1 | 12/2017 | Chung et al. | |

FOREIGN PATENT DOCUMENTS

| | | |
|---|---|---|
| EP | 1236634 | 9/2002 |
| WO | 2011/162605 | 12/2011 |

OTHER PUBLICATIONS

Michael David, Protran Technology, "Real-time monitoring keeps an eye on rail defects", Aug. 29, 2014, 4 pages.
Protran Technology, "Collision Avoidance System™ Vehicle to Vehicle and Vehicle to Worker Advance Warning", Sep. 19, 2014, 3 pages.
Protran Technology, "Emergency Engine Stop™ Shuttle Wagon/Locomotive Wireless Engine Stop", Sep. 18, 2014, 3 pages.
Protran Technology, "Intelligent Rail Integrity System (IRIS)™ Rail Neutral Monitoring System", Sep. 18, 2014, 3 pages.
Protran Technology, "Protracker™ PTC—Roadway Worker Protection System Track Walker/Worker—Train Operator—Advance Warning Devices", Sep. 18, 2014, 3 pages.
Jurgen Dickmann et al., "Making Bertha See", North American, Aug. 2014, pp. 44-49.
The Federal Register, "Positive Train Control Systems (RRR)", a Rule by the Federal Railroad Administration, the Daily Journal of the United States Government, Aug. 22, 2014, 63 pages.
William C. Vantuono, Editor-in-Chief, "Protran lands collision avoidance system contracts", http://www.railwayage.com/index.php/communications/protran-lands-collision-avoidance-system-contracts.html, Jul. 30, 2014, 1 page.
Mischa Wanek-Libman, Engineering Editor, "Exemptions expanded in FRA's final PTC rule", http://www.railwayage.com/index.php/ptc/exemptions-expanded-in-fras-final-ptc-rule.html, Aug. 22, 2014, 1 page.
International Searching Authority/U.S., "International Search Report and Written Opinion" International Application No. PCT/US2015/043736, dated Dec. 28, 2015, 17 pgs.
European Patent Office, "Supplementary European Search Report", European Application No. 15829433, dated Feb. 28, 2018, 9 pgs.

* cited by examiner

POSITIVE TRAIN CONTROL SYSTEM AND APPARATUS EMPLOYING RFID DEVICES

This Application claims the benefit of U.S. Provisional Application No. 62/499,863 filed Feb. 6, 2017, and entitled "Design of an Electronic Train Control System for Parts of the Rail Network (e.g., Tanzania)," which is hereby incorporated herein by reference in its entirety.

The present invention relates to train control and, in particular, to a train control apparatus or unit and system and method employing RFID devices in the track way.

Trains have been and continue to be a substantial, viable and economical means for transporting cargo and passengers, especially over short to medium distances where air travel is either too expensive or inconvenient, e.g., due to travel to and from airports outside of cities and delays due to security procedures. Hundreds of thousands or millions of people travel on commuter trains, regional rail lines, metros and subway trains each day, and so safety is of great importance.

In certain parts of the world, reliance upon trains is greater because of their relatively inexpensive operating cost and already extant infrastructure. Such infrastructure may be outdated and in less than good repair, often due to long usage and lack of making technological improvements, and sometimes due to the difficulty of maintaining sound fixed infrastructure when vandals, thieves and/or terrorists are intent on rededicating parts of such infrastructure to their personal use or to another use other than by the railroad.

Collisions with objects on the track and derailments appear to be the two most common sorts of train accidents, and in many cases occur together. Track and right of way anomalies, e.g., due to improper switch position and/or incomplete switch transfer, and track distortion and/or defects, as well as objects in the right of way, often contribute to such accidents, which often cause personal injury and death, spills and releases of materials dangerous to health and/or the environment, and damage to property both along the track and right of way, as well as some distance from the track.

Often scores or hundreds of people are injured or killed or placed at risk, hazardous and/or dangerous chemicals have been released, and even entire neighborhoods and towns have been damaged or had to be evacuated. The economic damage can easily rise into the millions of dollars from even what might appear to be a relatively "minor" accident.

Control of train movement may be by a system of geographically "fixed blocks" of track in which each block or length of track would have to be clear of trains before another train was allowed to enter the fixed block. Signaling and switching was manually controlled at first, e.g., by a dispatcher in a wayside tower, and later was automated to some degree as technology advanced, e.g., with electrical signaling. Typically the geographic blocks can be large and so track utilization is low, but it works relatively well if the travel direction and speed of the trains is similar, the track is in good condition, and there is no human error of the part of the train operators and the dispatchers.

Because trains operate in fixed block systems based upon what is supposed to be the track situation ahead, actual conditions often deviated what was supposed to be, and accidents were frequent and often disastrous. Fixed block controls are still in widespread use for lightly used rail systems as well as in parts of the world where modern, high-tech infrastructure may not yet be available and/or affordable.

One approach to reducing the risk of such accidents has been to mandate so-called "positive train control" as is required by the "Rail Safety Improvement Act of 2008" which was enacted in the United States. Among the intended safety benefits are maintaining train separation, avoiding collisions, enforcing line speed, implementing temporary speed restrictions and improving rail worker wayside safety. One result has been the increase in computer based train control that is understood to rely on centralized computers that employ radio communication to monitor train movement and track conditions.

Conventional approaches to positive train control are understood to rely on reporting to a central computer or facility the position and operation of individual trains, the accumulation and monitoring of data relating to the trains operating on the rail system, track and wayside data, and the like, from conventional sources, and the communication of that data and operating orders to all of the trains. This complex system necessarily relies on a complex communication system that must interconnect all of the trains and all of the various wayside and track sensors for the continuous transmission of data and status information from all system elements to the central computer and for communicating coordinating data, operating instructions, alerting and control instructions to all of the trains and all of the system elements and sensors.

Not only does this kind of system necessarily complicate the communications system requirements, e.g., for achieving suitable reliability, accuracy and redundancy, but it also necessarily requires massive reliable and redundant central computing resources, all of which are expensive. Such systems as used in the United States can be too complex and too expensive to be implemented in parts of the world where either financing and/or infrastructure is limited.

Because such system, e.g., a centrally controlled system, must be "failsafe" in that any failure of equipment and/or communication must be quickly responded to by placing the entire railroad and all trains thereon into a safe operating condition. This is usually implemented by reverting to an absolute block operation wherein train speeds are substantially reduced, e.g., to 25 mph where wayside signals are not present or are not operating and to under 50 mph where wayside signals are present and are operating, which is not the case in certain parts of the world, e.g., in developing nations, and train separation is substantially increased, thereby substantially reducing the capacity and efficiency of the entire affected rail system.

In addition, in certain locales there is a problem with vandalism and/or theft of installed infrastructure and apparatus, and so it would seem desirable to provide a train control system that may reduce the apparent infrastructure and/or hide its infrastructure so as to reduce damage to and/or loss of such infrastructure, as well as to avoid the reduction in the level of safety provided thereby were it to be damaged or removed. Typical U.S. style positive train control systems employ extensive signaling and require substantial track way infrastructure, all of which is exposed and apparent to would be vandals, thieves and terrorists.

Applicant believes there may also be a need for a train control apparatus that may provide a less complex and less costly alternative to conventional expensive systems relying on centralized monitoring and control relying on sophisticated on-track infrastructure. Applicant also believes there may be a need for track related infrastructure that is relatively simple and low in cost, relatively small, and/or relatively easily installed such that its presence is not evident, e.g., not visually apparent.

Accordingly, a positive train control system may comprise: a plurality of RFID devices embedded below grade in a track way, and each of the embedded RFID devices having stored therein data including a unique identifier, location data for the geographic location whereat it is embedded, or both, wherein the unique identifier is associated with the geographic location; a positive train control unit mounted on a train wherein each train has a unique train identifier and is authorized to operate in accordance with a train routing order, including: an RFID reader/detector mounted on the train including an antenna mounted in a location detecting and reading the unique identifier and location data stored in ones of the RFID devices when the train is proximate thereto; a processor for determining from the unique identifier and/or from the location data whether the train is at a geographic location consistent with a train routing order, or for causing the unique identifier and/or the location data to be transmitted by a communication device, or both; an operator alert device for providing messages, alerts and warnings in a human perceivable form; and a central facility including: a central facility communication system for receiving transmissions from one or more trains operating on the track way and for transmitting to the one or more trains operating on the track way; one or more servers for receiving unique identifiers, location data and unique train identifiers received by the central facility communication system, and for determining whether each of the one or more trains is operating at a location and time consistent with its train routing order; wherein the one or more servers generate a message, alert and/or warning when the location and/or time for the particular train is not consistent with the train routing order and the central facility communication system transmits the message, alert and/or warning; wherein the communication device on the particular train receives the message, alert and/or warning transmitted by the central facility communication system and responds thereto by providing the message, alert and/or warning in human perceivable form via the operator alert device.

Further, a method for positive train control may comprise: embedding in the track way or having embedded in the track way a plurality of RFID devices below grade, and each embedded RFID device having stored therein data including a unique identifier, location data including the geographic location whereat the embedded RFID device is embedded, or both, wherein the unique identifier is associated with the geographic location whereat the embedded RFID device is embedded; providing or obtaining a positive train control unit for mounting on a train wherein each train has a unique train identifier and is authorized to operate in accordance with a train routing order, the positive train control unit performing the steps of: detecting/reading the unique identifier and/or the location data stored in ones of the RFID devices when the train is proximate each particular one of the embedded RFID devices; transmitting the unique identifier and/or the location data received from the embedded RFID devices and a unique train identifier, and/or determining from the location data and/or from the unique identifier whether the train is at a geographic location consistent with a train routing order, or both; and providing or obtaining a central facility performing the steps of: receiving transmissions including location data and unique train identifiers from one or more trains and transmitting to the one or more trains; processing the received data to determine whether each of the one or more trains is operating at a location and at a time consistent with a respective train routing order; generating a message, alert and/or warning for a particular train when the location and/or time for the particular train is not consistent with the train routing order therefor and transmitting the message, alert and/or warning to the particular train; the particular train receiving and responding to the message, alert and/or warning for the particular train by providing the message, alert and/or warning in human perceivable form via an operator alert device.

In summarizing the arrangements described and/or claimed herein, a selection of concepts and/or elements and/or steps that are described in the detailed description herein may be made or simplified. Any summary is not intended to identify key features, elements and/or steps, or essential features, elements and/or steps, relating to the claimed subject matter, and so are not intended to be limiting and should not be construed to be limiting of or defining of the scope and breadth of the claimed subject matter.

BRIEF DESCRIPTION OF THE DRAWING

The detailed description of the preferred embodiment(s) will be more easily and better understood when read in conjunction with the FIGURES of the Drawing which include.

Figure 1:
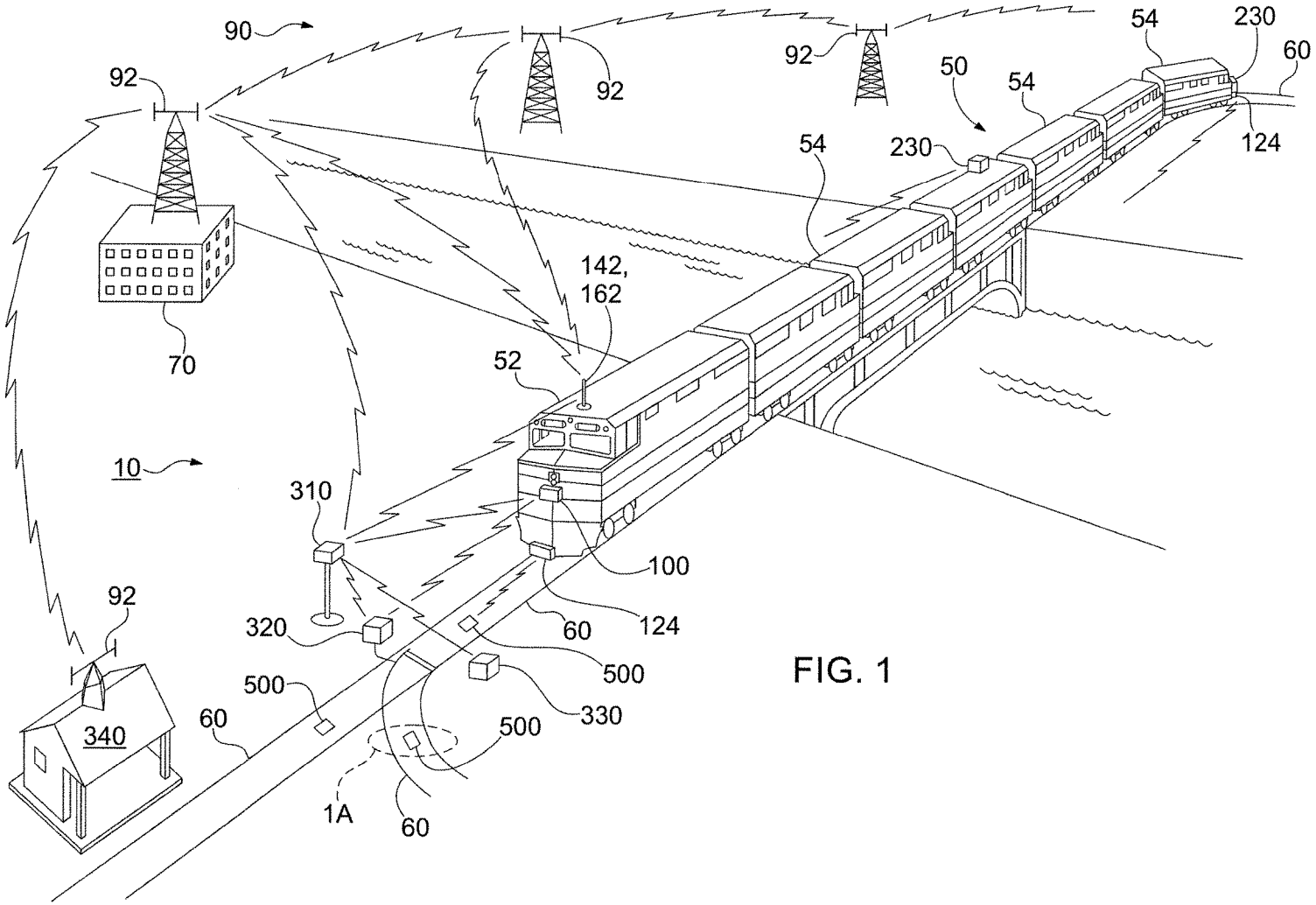
FIG. 1 is a schematic diagram illustrating an example embodiment of a positive train control system including a positive train control unit mounted to the front of a vehicle which is on a track way which includes plural track way RFID devices.

In the Drawing, where an element or feature is shown in more than one drawing figure, the same alphanumeric designation may be used to designate such element or feature in each figure, and where a closely related or modified element is shown in a figure, the same alphanumerical designation primed or designated "a" or "b" or the like may be used to designate the modified element or feature. Similarly, similar elements or features may be designated by like alphanumeric designations in different figures of the Drawing and with similar nomenclature in the specification. According to common practice, the various features of the drawing are not to scale, and the dimensions of the various features may be arbitrarily expanded or reduced for clarity, and any value stated in any Figure is given by way of example only.

DESCRIPTION OF THE PREFERRED EMBODIMENT(S)

Figure 1A:
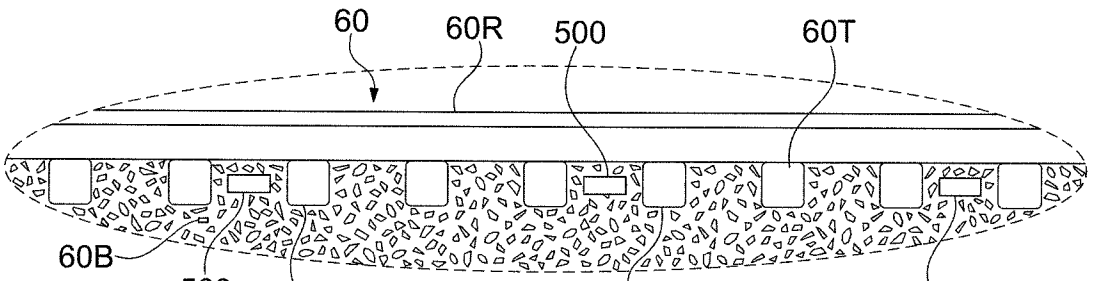
FIG. 1A is a cross-sectional view of an example part along the track way.
Figure 2:
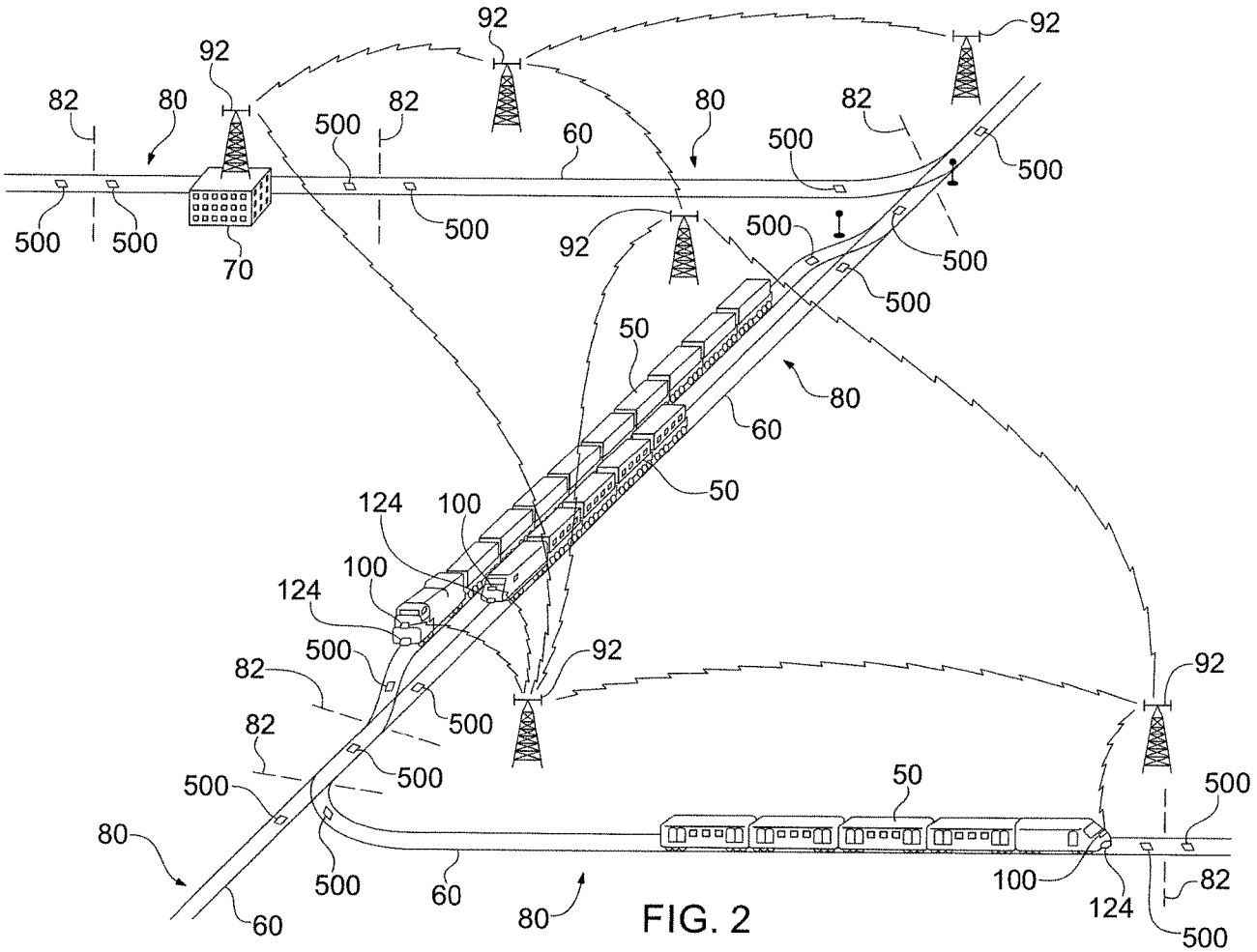
FIG. 2 is a schematic diagram illustrating an example fixed block track way system employing an embodiment of FIG. 1 for separating vehicles by a safe distance.
Figure 2A:
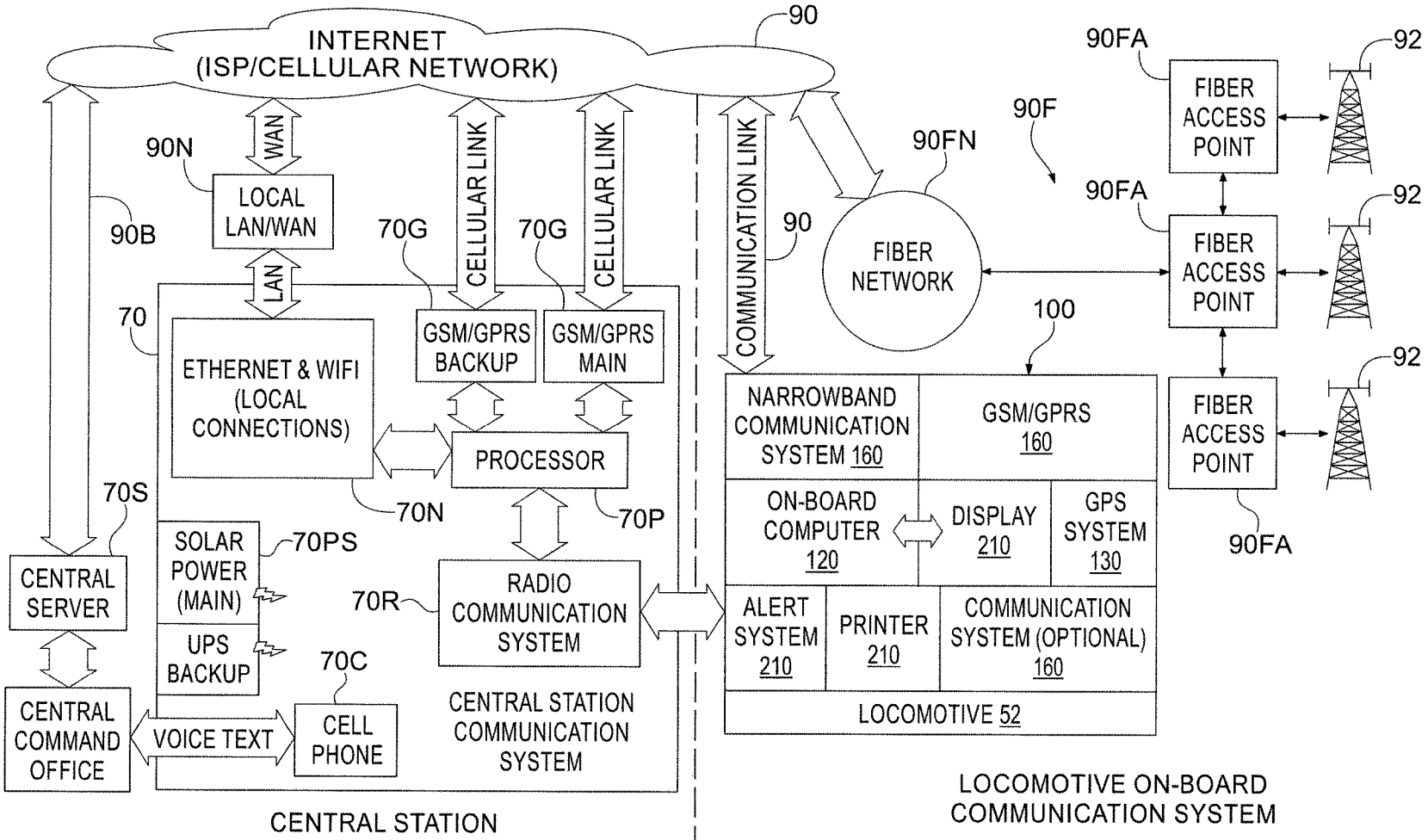
FIG. 2A is a schematic block diagram relating to an example central control facility thereof.

FIG. 1 is a schematic diagram illustrating an example embodiment of a positive train control system 10 including a positive train control unit 100 mounted to the front of a vehicle 50 which is on a track way 60 including plural track way RFID devices 500; FIG. 1A is a cross-sectional view of an example part along the track way 60; FIG. 2 is a schematic diagram illustrating an example fixed block track way 60 system employing an embodiment of FIG. 1 for separating vehicles 50 by a safe distance, and FIG. 2A is a schematic block diagram relating to an example central control facility 70 thereof. Vehicle 50, e.g., a train 50, may include one or more engines or locomotives 52 (or a motorized carriage or other self-propulsive unit) and may also include one or more carriages 54, e.g., passenger cars, freight cars, gondola cars, hopper cars, flat cars, piggyback cars, container cars, cabooses, and the like. While a railroad train and a railroad track is illustrated as typical, the present arrangement may be employed with any other type or kind of vehicle 50 operating on and/or along any type and kind of guided pathway 60 or other right of way of any type or kind.

Positive train control system 10 comprises a central control facility 70 which is actively inter-operative with trains 50 operating on the system of track ways 60 to receive data from and to transmit data to positive train control units 100 that are mounted on each train 60 via a communication system 90 that links all or substantially all of the locations of and along track ways 60. Various monitoring and/or reporting stations 310, 310, 330, 340 also receive data from and transmit data to central control facility 70 and/or positive train control units 100 that are mounted on each train 60 via communication system 90.

Positive train control unit 100 is preferably mounted at the front of train 50 so as to have a clear field of view forward of train 50 in the direction it is traveling. Positive train control unit 100 includes an RFID reader/detector 124 mounted on the train 50, preferably on or proximate the locomotive or other first car 52 thereof, for reading RFID control devices 500 that are preferably embedded in the track way 60. In a preferred arrangement, RFID reader 124 may include an external antenna 124A that is mounted to the underside of the train 50 and an RFID reader control 124 that is included with or in proximity to positive train control unit 100.

In one preferred embodiment a passive RFID device and a compatible RFID reader/detector operate in the UHF frequency band, e.g., at about 900-1100 MHZ. The RFID devices are preferably enclosed in a water resistant container such as a "metal water-capable" container which is transparent to UHF band signals which can be embedded between the rails beneath the surface of the track bed, e.g., at a depth of at least two inches (about 5 cm), e.g., close to a cross tie or sleeper.

RFID devices 500 are preferably located at the entrance to and exit from each block of each track (a block of single track may be about one kilometer in length where not having a switch, station or other feature), at the entrance to and exit from each siding, at the entrance to and exit from each station, as well as where spurs and the like branch off from a track and the like. Where a block is long, RFID devices 500 may be provided within the block, e.g., about 0.6 mile (about 1 km) apart.

Positive train control unit 100 may also include various sensors of different types, e.g., visible, infrared, radar, acoustic and the like, that monitor the way ahead to detect and identify objects, anomalies and/or other conditions that might affect the safety of train 50 and an on board processor to process the data from those sensors and from other sources, so as to provide indications of conditions ahead to the train crew, e.g., including the train operator, to other trains and to a central control facility 70. In the instance where the indication is a warning or alert, take appropriate action to control the train 50 if the train crew does not appropriately respond to the warning or alert in a timely manner.

The positive train control 100 may, via processor 120 and/or via central facility 70 and the servers thereof, communicate a control signal to a train control 220 on the train 50 to at least adjust the speed of the train when the message, alert and/or warning is generated, and/or may cause the train control 220 to reduce the speed of the train 50 and/or to stop the train 50 in accordance with a predetermined speed reduction profile or with a predetermined safe emergency speed reduction profile, or both, in response to the control signal. Alternatively and/or additionally, central facility 70, e.g., the servers thereof, may modify the train routing order and via positive train control 100 direct the train to a siding or to a different track in accordance with the modified train routing order, thereby to move train 50 to a track and/or location where the hazard or danger represented by a message, alert and/or warning may be avoided.

Alternatively and/or additionally, an operator on a train 50 may in concert with central facility 70, e.g., the servers and/or personnel thereof, and/or in concert with other system resources and personnel, e.g., a station master or yard master, may modify the train routing order manually via manual input via operator alert device 210. Typically such manual changes to a train routing order would be needed only under unusual circumstances, e.g., a breakdown of usual communication, and ordinarily would not be permitted to be completed absent coordination directly or indirectly with central facility 70. Thereafter train 50 would operate via positive train control 100 direct the train, e.g., to a siding or to a different track, in accordance with the modified train routing order.

One important aspect of train control is knowing the true location of the train 50 on the track way, both absolutely and relative to the routing authorized for that train. positive train control unit 100 includes one of more locating devices, e.g., a GPS or similar locating devices, typically systems employing satellites, for determining the absolute location of the train 50 on the Earth, and in cooperation with track maps that are digitally stored by the positive train control unit 100 and/or at a central control facility 70, the location of the train 50 on the track way 60, e.g., on a particular track 60 and location thereof. However, GPS locating can be unreliable and/or imprecise due to obstacles that block, reflect and/or distort signals transmitted by the satellites utilized in such locating system, and/or due to unavailability of satellites in view or satellite signals.

To provide an absolute location reference both absolutely and relative to a track 60, RFID control devices are provided at predetermined known locations along each track of a track way 60. Typically, RFID control devices 500 are installed before and after each and every junction of track way 60, e.g., before and after each switch (at every entry and exit therefrom), at crossings of tracks, at cross-overs of tracks, at roadway grade crossings, and the like. In particular, it is preferred that plural RFID control devices 500, typically at least three spaced apart RFID control devices 500, be provided at each such location. RFID control devices 500 are preferably buried below grade in the rock ballast 60B between the cross ties 60T of the track 60, and may be affixed to the cross ties.

Each RFID control device 500 is pre-programmed with data representing its exact location on the Earth (e.g., as determined by a known reliable and accurate precision GPS locator and/or by survey. Each RFID control device 500 is also pre-programmed with identifying data representing the track and location thereon, e.g., an absolute location reference, for the precise location where that RFID control device 500 is installed. In addition, each RFID control device 500 contains a unique identifier for its physical hardware that is pre-programmed therein and unchangeable, and may also contain a check sum, hashing, encryption and/or other error detecting, error correcting and/or security enhancing data.

Thus when a train 50 passes an installed RFID device 500, RFID reader 124 thereof, directly or via an antenna 124A, mounted to the underside of the train 50 interrogates and reads the location data, the track identifying data, the unique identifier stored in the RFID control device 500. Because plural, e.g., three, RFID control devices 500 are provided at each location, RFID reader 124 should receive the same location data and track identifying data from each RFID control device 500 and the on-board processor compares those plural, e.g., three, received data for consistency. If at least two of the three received data are consistent, there can be a reasonable confidence that the data is correct. In addition, from the track data stored in the on-board processor, the unique identifiers of the plural RFID control devices 500 can also be compared to verify that the expected RFID control devices are at the expected location.

If the received data and/or the security verification thereof indicates an anomaly, e.g., the train is on the wrong track or heading in an unexpected direction, or the RFID control devices are not those indicated as being installed at the present location, then an indication thereof can provide substantial advance warning to the operating crew and to take appropriate action to slow and/or stop the train should the crew fail to take appropriate and timely action. In addition such data and indications are communicated to the central control facility 70 and may be communicated directly to other trains that are within communication range.

When forward-looking sensors are included in positive train control unit 100, it is noted that the combination of data from different types of forward-looking sensors, e.g., a visible sensor that is more useful during daylight, an IR sensor that is useful during daylight and darkness, a radar that can sense through fog and precipitation, and an acoustic sensor that "hears" what the other sensors may not see, complement each other to provide a more complete and detailed assessment of what lies ahead of positive train control unit 100, including any objects, obstructions or other danger, than can any sense individually. In addition, sensing and detection of such condition is performed automatically and continuously so as to provide substantial advance warning to the operating crew and to take appropriate action to slow and/or stop the train should the crew fail to take appropriate and timely action. In addition such data and indications are communicated to the central control facility 70 and may be communicated directly or indirectly to other trains that are within communication range and to the central control facility 70.

Among the other sources and/or sensors employed can be one or more train monitors 230 that are mounted at predetermined locations on the train 50. A train monitor 230 and an RFID reader 124 are preferably and typically provided on the last car of the train 50 to detect when the last car passes an RFID control unit 500 in track 60 (e.g., plural RFID control units 500) and to wirelessly transmit the data received therefrom to positive train control unit 100 on the first car or locomotive 52 which then validates the data from those RFID control units 500 in the same manner as it validates data received via RFID reader 124 on the locomotive 52. The train monitor 230 if provided on the last car of the train may optionally communicate, preferably wirelessly communicate, e.g., its location to positive train control unit 100 so that the length of train 50 can be determined and monitored, whereby a loss of integrity, e.g., a decoupling of cars, can be detected. In addition, the location data as read by RFID reader/detectors 124 and 230 may be compared to determine whether train 50 is entirely within a given block, e.g., a track block and/or siding and/or station, and/or when it is entering and exiting such block and/or siding and/or station. Such train monitor 230 may include one or more imagers to provide visibility along track 60 in the direction rearward of train 50.

Optionally, and in addition, one or more train monitors 230 may be placed on one or more cars along train 50, e.g., as where such car may need special monitoring due to, e.g., its contents, hazardous materials, high value cargo, classified cargo, need for security, and/or any other particular need.

Optionally, and in addition, located along track 60 may be one or more monitoring units 310-330 that are located so as to monitor and detect abnormal conditions and/or deviations from a nominal condition. For example, a wayside monitor 310 may be provided e.g., where the track configuration is deemed to need monitoring because of its nature, e.g., a curvature and/or elevation profile that restricts the distance over which the track can be viewed, e.g., monitored by a positive train control unit 100 on a train 50, as described below. A wayside monitor 310 may also be employed to monitor unusually unstable areas, e.g., areas known to experience frequent natural changes, such as rock slides and/or flooding and the like. One or more example embodiments of a wayside monitor 310 are described below.

A switch monitor 320 may be placed on a switch to monitor the operation and, in particular, the completion of switch closure in either the straight ahead or diverting positions of the switching rails. Switch monitors 320 preferably directly sense the position of the moveable switch rails at the locations where they are supposed to be closely adjacent to fixed rails, e.g., the stock rails, to directly confirm that the switch rails have fully moved, and to do so independently of any conventional switch controls. One or more example embodiments of a switch monitor 320 are described below.

A track monitor 330 may be placed along a track to monitor the spacing and distortion of the rails, such as may result from high and/or low rail temperature, and/or from instability in the rail bed, such as may result from subsidence or shifting earth or vandalism. One or more example embodiments of a track monitor 330 are described below.

While wayside monitors 310, switch monitors 320 and track monitors 330 communicate the data they sense to a central computer and/or control facility 70, the monitors 310-330 described herein preferably include local communication devices, and preferably plural local communication devices for redundancy, that communicate sensed data directly to the positive train control units 100 on trains 50 that are within local communication range, e.g., typically within 2-5 kilometers, as indicated by the jagged lines in FIG. 1.

A communication system 90, including various communication devices 92, e.g., transmitters 92 and/or receivers 92 and or relays 92, typically disposed upon structures, e.g., buildings and/or towers, in suitable locations, provides communication links of various types and kinds between and among trains 50, monitors 300, 310, 320, 330 and one or more central control facilities 70. Such communication devices may typically employ jamming and interference resistance transmission protocols and/or may operate on different bands, and may have additional transponders 92 and/or relays 92 associated therewith, which may be closely and/or remotely located, all so as to increase the reliability and accuracy of communication, e.g., given the geographic and topographic conditions associated with their geographic locations.

Communication with the central control system 70 and/or positive train control unit 100 and/or with wayside monitors 310, which is preferably via a wireless cellular network, e.g., a GSM cellular network, may be augmented by and/or backed up by one or more redundant communication links and/or paths, including, e.g., a radio network, e.g., operating at about 800 or 868 MHZ in the UHF frequency band, with power levels appropriate to the distance to nearby communication equipment which may be a few kilometers or may be more than 40 km, one or more repeaters and/or relays, one or more land lines and/or optical fibers, satellite links, Internet connections, LAN networks, and the like as may be necessary or desirable in a particular implementation. Alternatively, communication may be, e.g., in a 443 MHZ and/or 915 MHZ frequency band, or any other suitable band.

Communication system 90 may include a long range WiFi network that can provide broadband communication, e.g., including video imaging and audio channels, within a range of about 6-18 miles (about 10-30 km), which may provide direct communication between trains and between trains and stations in addition to other, e.g., indirect, communication paths. Preferably the various elements of communication system 90 have a range of at least about 6 miles (about 10 km), e.g., to provide an additional direct and reliable communication link for reducing the likelihood of a collision or other accident should a system outage or failure of communication occur.

Also preferably, communication via communication system 90 is conducted according to a predetermined protocol the includes security and accuracy validating features, e.g., such as spread spectrum, secure encryption, two-way "handshaking" protocols, and the like, as well as the tagging of messages with the unique identifier of the transmitting system, e.g., the on-train communication device or the central facility communication device, and/or the location, date and time of transmission, e.g., geo-tagging and date-time stamping.

Example train 50 herein typically operates in a static or fixed block system illustrated in FIG. 2, although a dynamic or moving block system that sets a safe separation distance in front of train 50 and spaced from any train ahead of train 50 may be utilized. Where positive train control unit 100 senses track conditions ahead of train 50 and the operating conditions of train 50 and processes that data on board train 50, as well as transmitting the data to a central control facility 70, e.g., via communication system 90, 92, the separation distance for the block may be modified in "real time" as may be facilitated by communication with the central train control computer or facility 70.

A typical track way 60 system includes lengths of uninterrupted track 60, switches to branch tracks, switches for entering and leaving sidings, lengths of track whereat a train often ceases to move, e.g., a station 340 and/or other loading or unloading facility 340. Each of those is accommodated within a system of fixed blocks, i.e. lengths of track wherein a train is free to move anywhere within the block, but may not exit the block or move into another block absent authorization from the central control facility 70 that the block to be entered is clear. Typical examples of fixed blocks 80 and boundaries 82 between adjacent fixed blocks are illustrated in FIG. 2 wherein plural RFID control devices 500 are located at the entrance to and the exit from each fixed block 80. Typically, each siding and each station 340 may be a fixed block 80.

Central control facility 70 typically includes communication equipment for establishing communication via communication system 90 with various trains 50, monitors 310-330 and stations 340 as may be included in a system of track ways 60 and various computers, servers, processors, memory devices, storage devices, displays and monitors, all items 70S and 70P, and the like for receiving data transmitted by trains 50, monitors 310-330 and stations 340. Various encryption, verification, firewall and other protective devices are also provided and employed, e.g., in communication links 90 such as broadband links 70B, GSM or GPRS or other wireless and/or cellular links 70G and other links and/or networks 70N. A radio communication system 70R preferably provides direct radio communication for voice, text message and data between central facility 70 and various trains 50, monitors 310-330 and stations 340 or via one or more radio relays and/or repeaters 92. Communication system 90 may link various transmitters, repeaters and/or relays 92 with each other and/or with central facility 70 via a fiber optic network 90FN which may include one or more fiber access points 90FA.

Preferably, central facility 70 includes back up and redundant computers, processors, servers, storage, and the like, e.g., included in items 70PS, as well as back up and/or redundant communication and other devices, e.g., included in items 70G, 70N, 70R, 90, 90B, optionally including some or all of such being at a different physical location, are provided for redundancy and increased reliability. While utility power, AC line power, and/or solar power or another source of electrical power 70PS may be utilized as a primary source of electrical power for central facility 70, a battery, electrical generator or other back up electrical power source 70PS may be provided therewith so that electrical power is effectively uninterruptible should the primary source thereof become unavailable. In addition, communication via voice and/or text message, e.g., via the Internet, via wired or fiber devices and/or networks and/or via cellular devices 70C, may be provided within central control facility 70.

Figure 3:
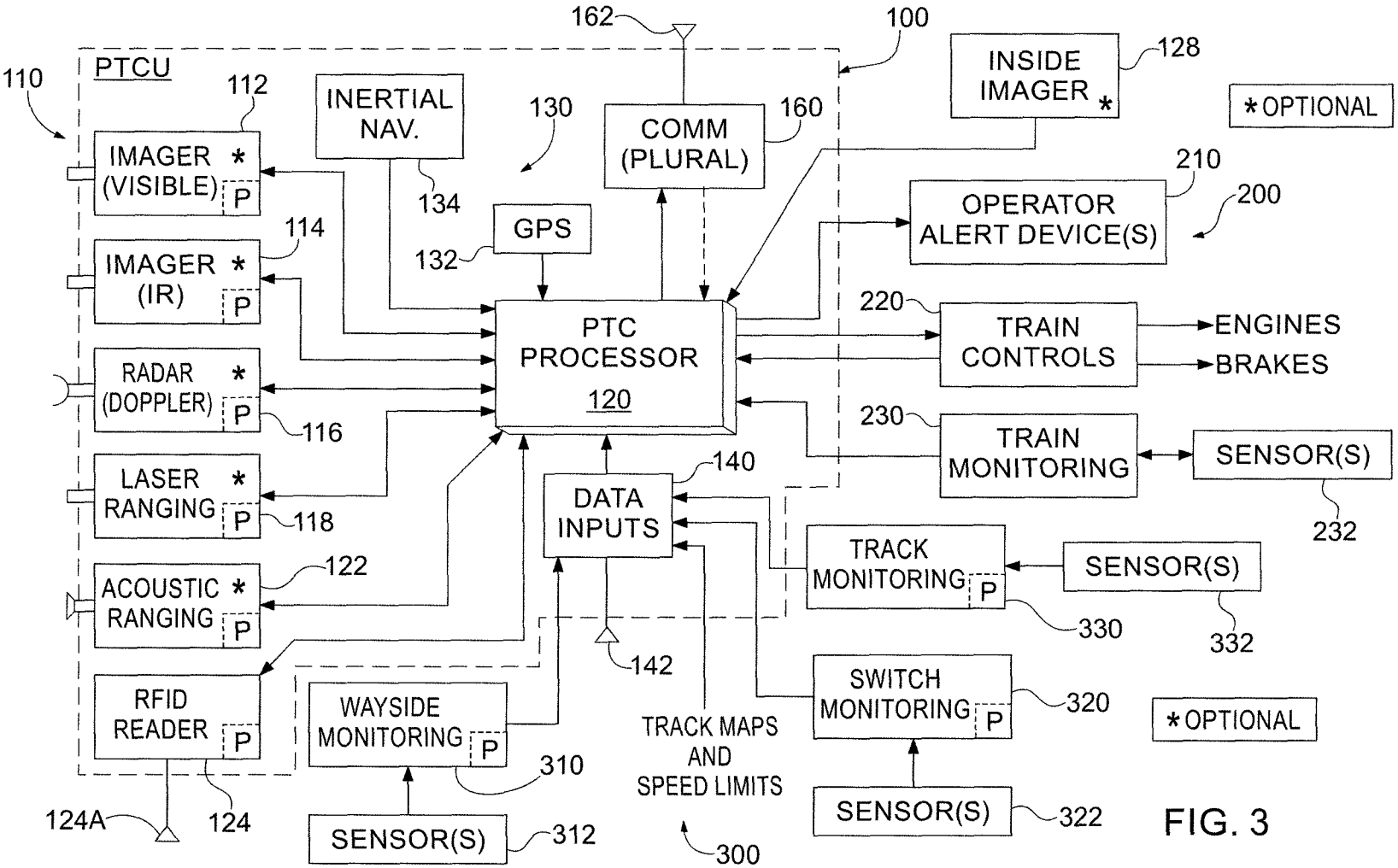
FIG. 3 is a schematic block diagram of an example embodiment of a positive train control unit including an RFID reader/detector suitable for mounting to a train.
Figure 4:
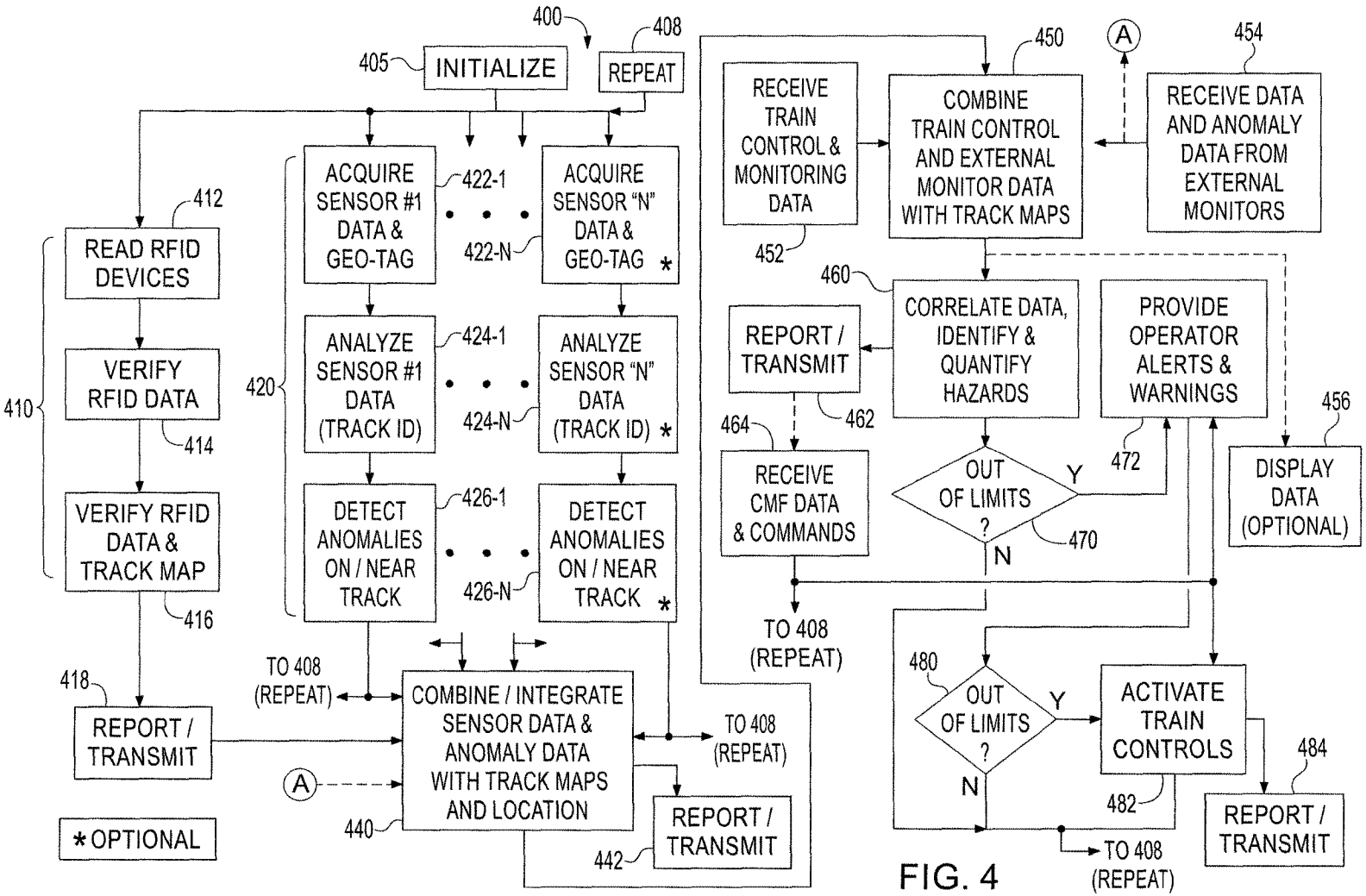
FIG. 4 is a schematic flow diagram illustrating operation of the example embodiment of FIG. 3.

FIG. 3 is a schematic block diagram of an example embodiment of a positive train control unit 100 including an RFID reader/detector 124 suitable for mounting to a train; and FIG. 4 is a schematic flow diagram illustrating operation of the example embodiment of positive train control unit 100 of FIG. 3. Positive train control unit 100 includes a positive train control processor 120 comprising one or more microprocessors, microcontrollers, microcomputers, portable computers and the like, to provide one or more computing engines, memory (e.g., including random access and/or other volatile and/or non-volatile memory), input/output (I/O) ports, and data storage (e.g., including magnetic and/or optical drives, and/or large scale solid state semiconductor memory). Processor 120 receives data inputs from other elements of positive train control unit 100 including but not limited to one or more forward-looking sensors 110, one or more RFID readers/detectors 124, one or more locating devices 130, one or more data input devices 140 and one or more communication devices 160, of various types and configurations. Preferably, a unique identifier is stored in a memory, e.g., the memory of processor 120, of each positive train control unit 100 and/or RFID reader/detector 124 so as to uniquely identify that positive train control unit 100 and by association the train 50 on which it is mounted.

Positive train control unit 100 may be configured as an assembled unit that may be mounted or attached, either temporarily or permanently, to a movable vehicle, e.g., a train, or may be in one or more modules or units of equipment that are mounted to the train, and in either case interconnected therewith.

Preferably the RFID reader/detector 124 associated with positive train control unit 100 is mounted to the under carriage or underside of the train, typically at the forward most end thereof, where it will have a suitably clear field of view downward toward track 60 and the RFID devices 500 embedded therein, and so be able to detect, interrogate and/or read RFID devices 500 in real time, i.e. as the train 50 passes over each RFID device 500. In a preferred arrangement, each RFID reader/detector 124 may be and preferably has its transmitting/receiving antenna 124A mounted to the underside of the train 50, e.g., on the locomotive, engine or lead car thereof, with the control electronics 124 thereof mounted in a less exposed location, e.g., in the cab or control location of train 50 along with or as part of positive train control unit 100.

Each RFID reader/detector 124 may be and preferably is connected or coupled directly or indirectly, e.g., via processor 120, to one or more train systems 200, 210, train controls 220, and/or train equipment 230, typically via a predefined interface, e.g., using one or more electrical connectors, for receiving electrical power from the train and providing interconnections for communicating data therebetween.

Each RFID device 500 is pre-programmed with stored data uniquely identifying the RFID device, identifying the geographic location at which it is deployed, and identifying the particular track in which it is deployed. When read by RFID reader 124, this data from RFID device 500 provides an independent, unambiguous and positive identification of the geographic location of the train 50, 52 as well as of the track 60 on which the train 50, 52 is operating.

At each end of a block and at each track juncture, the one or more RFID readers 124 of train 50 pass over one or more embedded RFID devices 500 which are interrogated and read for the geographic and track data stored therein. Preferably, plural RFID devices 500 are embedded in track 60 at each block change and each track juncture, and train 50 carries on its lead car 52 plural RFID reader/detectors 124, thereby providing for plural redundant readings of each RFID device 500. For example, if a train 50 has two RFID reader/detectors 124 and there are three RFID devices at each block boundary and track juncture, positive train control unit 100 will receive six independent data readings that should represent the same information as to geographical location and track identification, and each of the readings will be associated with the unique identifier for the RFID device 500 from which it was read.

This redundancy of received data allows for a great variety of error checking tests to be made to verify the correctness and accuracy of the received data, and therefore the location of the train 50 on a particular track at a particular geographic location. Among these tests are verifying the geographic locations represented by the received location data against each other for consistency, verifying the track identifications represented by the received track data against each other for consistency, verifying the received geographic location data against the received track data for consistency, e.g., with a track map, and/or verifying the received location data against location data from an independent source, e.g., GPS locator 132 and/or inertial navigation unit 134.

In addition, the unique identifiers of each of the RFID devices 500 can be verified against either or both of location data and track data and/or against track maps received from a central facility 70 or stored on the train, e.g., in digital form in the memory of processor 120, either or both being tested, e.g., by a table look-up and comparison process. As a result of these checks and cross checks, the location and track for the train can be verified with a high degree of accuracy and confidence.

The foregoing not only serves to verify the location and track for train 50 to a high degree of accuracy and confidence, but also serves as verification of the integrity of the track 60 and of the RFID devices 500 embedded therein, e.g., that the RFID devices 500 are operating and are indeed in the locations at which they were originally installed, and if not, operating and management personnel can then be alerted to the discrepancy so that investigative and corrective action can be undertaken where indicated.

If, for example, a malefactor were to interchange the RFID devices 500 from location A with those from location B, the positive train control unit 100 of a train would identify consistent location data and track data therefrom at each location, however, the unique identifiers associated with each RFID device 500 would not match the locations at which such devices 500 were deployed and so the interchange would be detected, from which an appropriate response, e.g., a stop in place or proceed with caution order, could be initiated. Because the data read from RFID devised 500 is preferably processed by processor 120 of positive train control unit 100 of the train 50 and is transmitted to and processed at a central train control facility 70, any inconsistency in the data read from RFID devices 500 is detectable on the train 50 as well as at the central control facility 70, and so such appropriate responsive action can be initiated on-board train 50 or by command from the central control facility 70, or by both.

RFID reader/detector 124 (or at least the antenna 124A thereof) should be located as close to track 60 as is practical in view of the necessary and/or required train to track clearance, thereby to reduce the RF transmission path length between the RFID readers/detectors 124 and RFID devices 500. A clearance of about 1-2 feet (about 0.3-0.6 meter) above track (e.g., cross tie) level is believed to be sufficient while providing sufficiently accurate reading of RFID devices 500 that are embedded in the track ballast, e.g., at a depth of about 2 inches or more (about 5 cm or more), for an RFID reader 124 operating in the UHF RF frequency band that has a reading distance of about 3-6 feet (about 0.9-1.8 meters).

Typically an interrogation and reading cycle of an RFID device 500 requires only about 0.9 to 1.0 milliseconds. By way of example, a train operating at 60 miles per hour (about 100 km/hour) travels about 88 feet per second (about 26.8 meters per second), and so an RFID reader having a reading range of at least about 1.0 feet (about 0.3 meters) forward and rearward of its antenna, will have about 2/88 of a second or 22.7 milliseconds (or approximately 22-23 chances to read the RFID device) in which to read each embedded RFID device 500 as it passes underneath the train. This is more than sufficiently quick for reading RFID devices 500 accurately and reliably with the train operating at normal operating speeds.

To accommodate higher expected speeds, the RFID devices 500 may be spaced further apart along track way 60 and/or the interrogation and reading cycle of RFID reader/detector 124 may be shortened and/or made more frequent. For example, a train 50 operating at about 300 mph (about 482.8 Km/hour) will move about 440 feet (about 134 meters) in one second (or 2/440 or 4.5 chances to read the embedded RFID devices), so there typically are enough cycles to read a single RFID device 500.

For redundancy, plural RFID device may be suitably spaced apart, e.g., about 3.3 feet (about 1.0 meters) apart where the interrogation and reading cycle is about 1.0 millisecond. That is, with multiple devices such as three RFID devices 500, the chances of reading at least one device will be increased three fold or there will typically be at least 13.5 chances to read at least one RFID device 500. Of course, in parts of the world where trains operate at more modest speeds, RFID devices 500 may be spaced closer together if desirable and/or if lesser redundancy is required.

Even though one RFID device would be adequate for almost all train speeds of today, in general, multiple embedded RFID devices (e.g., two or more spaced) 1.0 to 10.0 meters apart will be adequate to provide sufficient the redundancy and reliability for each block, e.g., kilometer, of train track. By the same token, if multiple readers such as 2 to 3 units are mounted in adjacent to each other on the train, the chances of reading each RFID device 500 at any speed will also increase by the same factor of 2 to 3.

At least the part of an RFID reader/detector 124 that is mounted under a train is preferably enclosed in a robust and weather-resistant container through which interrogating signals transmitted to RFID devices 500 and return signals therefrom can pass, and may also be physically protected by a robust barrier or other structure on the undercarriage against objects that may be on the track or be ejected upward as the train passes.

Another advantage of RFID reader/detector 124, besides its proven technology, reliability and reasonable cost, is that its transmitting and/or receiving antenna 124A can be separated and located remotely from the electronic circuitry 124 that controls interrogations and processes return (read) signals, so that only the RFID antenna 124A need be located on the underside of the train car 52 and the control and processing circuitry can be located in a more benign environment, e.g., inside the train, as are other elements of positive train control unit 100 and/or train controls 220.

Preferably the positive train control unit 100 is mounted to the train at or at least near to the forward most end thereof where it will have a suitably clear field of view forward of the train and so be able to observe and/or sense what, if anything, lies ahead. Positive train control unit 100 including RFID reader/detector 124 is connected to one or more train systems 200 and/or equipment 200, typically via a predefined interface, e.g., using one or more electrical connectors, for receiving electrical power from the train and providing interconnections for communicating data therebetween.

Figure 5:
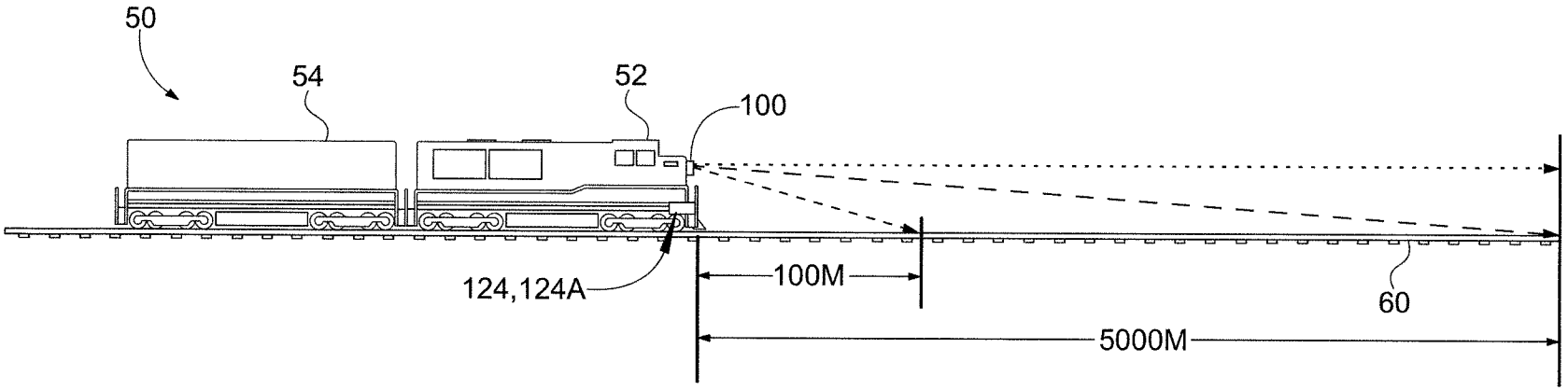
FIG. 5 is a schematic diagram illustrating various forward looking fields of view relating to the example embodiment of FIGS. 1-3.

The forward looking sensors 110 of positive train control unit 100 are preferably positioned in positive train control unit 100 and/or are mounted to the train 50, 52 so as to have suitable fields of view substantially directly forward from the train 50, 52 on which positive train control unit 100 is mounted, as is illustrated, e.g., in FIG. 5 which is a schematic diagram illustrating various forward looking fields of view (shown therein as lines of long dashes, short dashes and dots) relating to the example embodiment of positive train control unit 100 of FIGS. 1-3. In a practical sense, sensors with a longer forward range may be, and preferably are, mounted higher up from track way 60 and sensors with shorter range may be mounted closer to track 60, in a configuration selected to make best utilization of each sensor and of the places on locomotive 52 available for mounting sensors. Similarly, sensor 110 field of view may also be a consideration in selecting a sensor 110 mounting configuration. The field of view for RFID reader 124 and range is downward for a few feet and is relatively direct.

Some of sensors 110 may be positioned to have a field of view that extends and senses far forward, e.g., 2-5 kilometers forward, of train 50 while other of sensors 110 may be directed to sense closer, e.g., 100 meters to 500 meters, forward of train 50, while still others may be directed to sense over a range of distances intermediate thereto and/or overlapping therewith. The width of the field of view vertically is typically selected to provide the desired range of forward looking distance taking into account typical expected changes in elevation and/or inclination of the tracks 60, e.g., due to hills, overpasses, underpasses and the like, and the width of the field of view horizontally is selected to provide the desired range of forward looking distance including changes in azimuth of the tracks 60, e.g., due to right of way width, curves, parallel tracks, switch tracks and the like. Ones of sensors 110 that can sense over the entire 100 meter to 5 kilometer range may be employed to sense forward of train 50 for all or part of that range.

Sensors 110 may include one or more of visible band imagers 112 producing either sequential still images or video images, one or more infrared (IR) band imagers 114 producing either sequential still IR images or video IR images, one or more radar imagers including Doppler radars and other types of radars, one or more laser ranging devices 118, and/or one or more acoustic ranging and/or sonar ranging devices 122. Notably, the inclusion of plural and/or redundant sensors 110 has an economic cost that may not be affordable in developing countries. In a low-cost embodiment suitable for the limited available resources in developing nations, a visible band imager 112 may be the preferred, and possibly the only, sensor 110 employed in positive train control unit 100, along with an RFID reader/detector 124.

Data sensed by sensors 110 is communicated to positive train control unit processor 120 over cables, e.g., electrical cables and/or optical fiber cables, and processor 120 processes the sensor data to determine the track conditions, and to then determine whether any dangerous or hazardous condition exists, and based thereon to initiate appropriate actions to signal the train crew The distance over which the various sensors 110 preferably sense can range from relatively close range, e.g., 10-50 meters to one, two or five kilometers, thereby to encompass sensing over a length of track that exceeds at least the breaking distance of the train over the range of expected forward speeds at which it operates, as well as a guard band to account for processing time and possible inaccuracy, uncertainty, and the like. The respective sensor fields of view preferably extend over a range of elevations (vertical angles) and a range of widths or azimuth (horizontal angles) sufficient to sense the track ahead of the sensor including the variations in grade and/or curvature known to be permitted for the track. In some cases, one sensor can sense over the entire ranges of distance, elevation and azimuth, and in other cases, more than one sensor may be required to sense over the entire ranges of distance, elevation and azimuth, e.g., to take into account the sensing ranges of the various sensors as well as the effects of the environment (e.g., light, rain, fog, snow, darkness) on those ranges.

While any or all of sensors 100 may be employed, in a typical instance, especially where funding and/or other resources may be limited, only a visible imager 112, typically a forward looking imager 112 for wavelengths of visible light, may be provided. Employing at least a visible imager 112 is preferred and is sufficient for positively monitoring and controlling trains 50 on track way 60 including embedded RFID locating devices 500 as described herein, and in certain instances, even a visible imager 112 may be omitted even though preferred.

The geographic location, or geographic position, of positive train control unit 100 and of the part of the train to which it is mounted, e.g., usually the locomotive or engine or a control cab or a first car 52 at the front of the train 50, is determined by locating system 130, preferably at least to an accuracy which enables determination of the track 60 of a track way or railway having plural tracks 60 the train is on. That is not always the case, particularly in locations where GPS signals are blocked, reflected and/or distorted, as may be more prevalent in developing countries.

Locating system 130 preferably includes one or more Global Positioning System (GPS) units 132 operable with signals from GPS satellites to accurately determine the geographic position of the GPS unit 132 on the Earth. Use of plural locating units 132 reduces the likelihood of having a loss of location data due to inoperability of an on-board GPS device, but also increases cost which may be a problem in developing nations. Preferably, but optionally, global position determining units 132 for two or more different and independent global positioning systems, e.g., the US GPS system, the Russian GLONASS system, the European Galileo system, the Indian IRNSS system and/or the Chinese BDS system, may be employed so that geographic location data is available even when one GPS system is out of range or out of service, however, such redundancy has an economic cost that may not be affordable in developing countries.

In addition and also preferably, but optionally, one or more additional location determining units 134, e.g., a gyroscopic and/or inertial navigation device 134, that operate independently of the GPS units 132 may be provided, so as to operate even when the train is in a tunnel, underground or otherwise out of communication with GPS satellites. Use of plural different types of locating devices 132, 134 reduces the likelihood of having a loss of location data due to inoperability of an on-board locating device 132, 134 as well as an outage of signals from a locating system satellite and/or beacon.

In any event, the geographic location data and track data read by RFID reader 124 from RFID devices 500 embedded in track 60 is reliable and available even where GPS unit 132 is inaccurate or not functioning. However, redundancy provisions for locating devices 132, 234 may not be feasible or affordable in developing nations which is why the present arrangement employs RFID devices 500 that are embedded in the track 60 to provide pre-determined and known accurate geographical location data and predetermined known accurate track data, that is easily verifiable due to plural redundant RFID devices 500 at each location on the track 60 and plural redundant RFID readers//detectors 124 on each train 50.

Thus, even the failure of all location determining units 130 of one type would not completely deprive positive train control unit 100 of accurate geographic location data and track data from which the train 50 may be safely operated. Moreover, correlating or otherwise combining the location information provided by plural location determining units 130, 500-124 can provide location information to greater accuracy and/or with greater reliability and certainty than could only one location determining unit or one type of location determining unit.

All data produced by sensors 110, 124 is preferably associated with the location of positive train control unit 100 provided by location determination 130 or from RFID device 500 at the time the data was acquired, and is also time tagged, e.g., by processor 120, so that all sensor data is preferably both geo-tagged and time tagged for facilitating its being cross referenced to other data, e.g., both similar data and dissimilar data, for storing and processing such data within positive train control unit 100, and by the positive train control unit 100 of another train to which it may be transmitted, and at a central location or central control facility 70 to which such data is transmitted 160, 162.

It is noted that because the data acquired is geo-tagged so that the location of the sensor 110, 124 is precisely known relative to the track way 60 and is time tagged for correlation with other time tagged data, a complete representation of the operation of the train 60 may be determined at and/or for any given time, both on each train and on other trains in communication therewith, as well as at a central train control location 70, thereby to positively determine the location (including the track), speed and direction of the train 50 and to positively control its operation, as well as to aid in planning and execution train operations.

External data inputs 300 for positive train control unit 100 may be provided via data input device 140 which may include any number of data input devices, e.g., a keyboard, a touch screen, a USB drive reader, a memory card reader, a CD or DVD reader, a magnetic stripe reader, an RFID reader, wireless communication 90, 92 from a remote facility, e.g., a central control facility 70, and the like, and other sources. Data inputs may include, e.g., one or more of track maps and speed limits, data relating to embedded RFID devices 500, data from sensors 312 associated with wayside monitors 310, data from sensors 322 associated with switch monitors 320, and/or data from sensors 332 associated with track monitors 330, all of which may be communicated wirelessly. Accordingly, data input device 140 typically includes one or more wireless communication devices 140, e.g., a cellular communication device, operating via one or more antennas 142, e.g., mounted to train 50, typically and preferably to the locomotive 52 or another first car 52 thereof.

Operational communication is provided via a communications system 90 that employs various communications paths and types, e.g., for redundancy, for communications between and among trains, an on-board control system, a central control system 70, a central control facility 70, and fixed location control systems/stations, e.g., at stations 340, loading facilities 340, yards 340, and the like. Wireless communication may be via a cellular communication system 90 utilized for public cellular communication and/or for communication among and relating to trains 50 and track ways 60, 220 MHz communication devices 92 as utilized for communication with and between railroad trains, and/or via WiFi networks, ad hoc networks, cellular communication, bluetooth, RFID devices, and similar relatively local communication devices, which because of their independence from each other and their ability to establish and maintain communication networks and structures, can provide inherently robust and reliable data communication links. Communication ranges may be in the 1-5 kilometer range for communication by and between nearby trains and with nearby station, wayside, switch and track monitors 340, 310, 320, 330, and may be over much greater distances, e.g., up to 20 kilometer or more, e.g., for communication with a central train control facility 70.

Also among the communications types and paths preferably utilized are one or more types of communication links 90, 92 including, e.g., a cellular base-station and repeater system, a GSM cellular system, e.g., operating at 900 MHz or at another cellular frequency. It is noted that a cellular type of communication system 90, 92 that includes the capability to form communication links and networks with similar equipment can be particularly robust and reliable In general, such monitoring devices 310-330, in addition to communicating sensed data within a relatively local surrounding region, which includes any trains (and positive train control units) within its communication range, preferably also communicate the sensed data to a central computer or monitor at a central control facility 70. The central control facility 70 can and typically does communicate such data to the trains, e.g., to the positive train control units 100 thereon, thereby to provide a communication path or link between such monitors 310-330 and each positive train control unit 100 and the central control facility 70.

Positive train control unit 100 also typically includes one or more communication devices 160 which serve principally to communicate data from positive train control unit 100 to a central computer (solid line arrow) at a central control facility 70 and to communicate data from a central or control computer at the central control facility 70 to positive train control unit 100 (dashed arrow). Plural communication devices 160 may be employed for improved reliability and/or redundancy, and each may operate via one or more antennas 142, 162, e.g., located on train 50, and preferably on locomotive 52 thereof.

Processor 120 processes the data received from RFID reader/detector 124, sensors 110, locating system 130 and data input 300, 140 to determine the geographic location of the train (positive train control unit 100) on the track map and from that data can estimate, if not determine, its speed and direction, to compare that location, speed and position to the applicable train order, speed limits and known track conditions, e.g., as reported by one or more monitors 310-330, either directly or via a central control facility 70. Processor 120 overlays the determined data onto a track map to provide a geographic information system (GIS) map which is available to train crew and can be communicated 160 to the central or control computer at the central control facility 70. If an out of limits condition is determined, then processor 120 produces an indication thereof and determines an appropriate response, e.g., request a revised train order, indicate a collision is likely or not likely, reduce speed, apply brakes and/or apply brakes for an emergency stop.

A processor and/or computer at the central control facility 70 also overlays the determined data onto a system track map to provide a geographic information system (GIS) map pertaining to all trains and all track ways in the system, which is available to the central or control computer at the central control facility 70 as well as to train control and/or management personnel thereat, and can be communicated 160 to the various positive train control units 100 and to the train crews. If an out of limits condition is determined, then the central processor and/or computer produces an indication thereof and determines an appropriate response, e.g., request a revised train order, indicate a collision is likely or not likely, reduce speed, apply brakes and/or apply brakes for an emergency stop. The processor and/or computer at the central control facility 70 can communicate the indication and/or the response to the train crew, to the positive train control unit 100 on the train, or to both, either for the positive train control unit 100 and/or crew to initiate action in response or to initiate response action directly.

Processor 120 also processes the data received from RFID reader/detectors 124 and sensors 110 to analyze the location data, track data, images, ranging data and other data therefrom, e.g., by comparing such data to templates of known track configurations, objects and obstacles, e.g., templates of tracks, switches, sidings, people, animals, vehicles, trains, and the like, stored in its memory. Processor 120 determines therefrom along with location, track position, speed, direction and ranging data whether a track anomaly including a dangerous object is in the path of the train and if so, to provide an indication of such anomaly and/or object and related indications, e.g., derailment and/or collision likely or not likely, reduce speed, apply brakes and/or apply brakes for an emergency stop, and communicates the foregoing to the central control facility 70.

Data and indications from processor 120 may be communicated to an operator alert device 210 which may include one or more display monitors, an audible warning device, a visual warning device, a tactile warning device, or a combination thereof. The train crew being thus advised and/or warned of a condition, and being advised of an action to be taken, can then respond by taking appropriate action, all of which is monitored by processor 120 and communicated to the central control facility 70. In addition, and in some instances preferably, operator alert device 210 may include an input device for accepting a response manually entered by the operator, e.g., by a keyboard and/or by pressing a physical button or an iconic button on a display to indicate that the alert or warning has been received and/or has been received and acted upon. Lack of such response by the operator may indicate to the central monitoring facility 70 that further action, e.g., to contact the operator via a text message and/or voice channel or to take direct action via communication links 90, may be necessary or prudent to address whatever situation has arisen.

As a further verification and/or monitoring of the operator, an imager 128 may optionally be provided inside the cab or other operator station to capture and transmit to central control facility images of the inside of the cab or operator station, thereby to allow monitoring of the status therein including of the operator. Such imager 128 may operate at a low imaging rate, e.g., 1-3 frames per second, and may be a relatively simple and inexpensive device, e.g., a web camera or a simple cell phone with imager, and may transmit images via processor 120 and communication device 160 or may transmit images directly, e.g., via a cellular connection.

In a typical implementation, the operator display device 210 may be a tablet computer or an equivalent device which has a visible display upon which operational data, e.g., location, speed and direction, and messages, alerts and/or warnings, are displayed. Further, information from a train routing order and deviations from the train routing order that specifies the origin, track, routing, and destination of a train may also be displayed. Preferably operator display device 210 has an imager, e.g., a video imager, a microphone and a speaker, thereby to enable two-way audio and video communication between the operator on the train and operators on other trains and/or personnel at the central facility 70.

Train routing orders (or warrants) are typically communicated from central facility 70 to each train 50 using communication system 90, e.g., a secure and robust communication path as described, and may be for an entire route or for a part thereof, and may be updated and/or modified in whole or in part in like manner by central facility 70. Both the on-board positive train control 100 and the central facility 70 monitor the compliance of train 50 with the train routing order, e.g., as to location, speed, direction, track and time of report, and track its progress in conformity with the train routing order. To that end, all of the data transmitted be each train 50 is received at central facility 70 and is logged into memory of the servers thereof, e.g., as part of its monitoring function. Preferably, the lack of a timely report from a train 50 is deemed an anomaly to be at least investigated and/or corrected.

If the train crew or operator does not respond either properly or timely to the advice, alert and/or warning, processor 120 communicates the necessary action to be taken to the train control system 220 of the train and to the central control facility 70, either of which automatically initiates or takes the necessary and/or appropriate action, e.g., to reduce speed, apply the brakes and/or apply the brakes for an emergency stop.

Specifically, positive train control 100 may communicate a control signal to a train control 220 on the train 50 to at least adjust the speed of the train when the message, alert and/or warning is generated, and/or may cause the train control 220 to reduce the speed of the train 50 and/or to stop the train 50 in accordance with a predetermined speed reduction profile or with a predetermined safe emergency speed reduction profile, or both, in response to the control signal. Alternatively and/or additionally, the central facility 70, e.g., the servers thereat, may modify the train routing order and direct the train to a siding or to a different track in accordance with the modified train routing order, thereby to move train 50 to a track and/or location where the hazard or danger represented by a message, alert and/or warning may be avoided.

Because processor 120 and the train systems 200, e.g., including train control 220, are in direct communication, processor 120 receives train operating data from train control 220 that is processed to determine, e.g., train speed and direction (forward or reverse), brake and braking status, engine status, train integrity, train deadman device status, and the like, thereby to produce data from the train control that can be compared to data determined from RFID reader 124, from sensors 110, from locating system 130, and from data inputs and monitors 300 for consistency and accuracy, the lack of which would provide an indication of a device or other malfunction or failure for which an alert or warning may need to be given and/or action may need to be taken, and/or a notification transmitted to the central control facility 70.

It is noted that the processing and/or control functions performed by processor 120 may be performed by one or more processors 120, P and that one or more of those processors 120, P may be included in and/or associated with any one or more of sensors 112, 114, 116, 118 and/or 122, and/or RFID reader 124, as indicated and illustrated by the letter "P" therein. In any given arrangement of a positive train control unit 100, any or all of sensors 112, 114, 116, 118, 122 and/or 124 may include, and in some arrangements may preferably include, a processor P configured to efficiently process the data received and/or sensed by the sensors thereof. In such instance, sensors 112, 114, 116, 118, 122 and/or 124 provide output data that includes data representing any detected anomalies, including objects and/or conditions relating to the track way. That output data are then further processed by PTC processor 120, which serves as a central or common resource on the train 50, to provide combined and/or integrated data representative of track way and other conditions for effecting any necessary operator alerts 210 and/or train control 220 actions, as well as transmitting same to the central control facility 70. Overall control of positive train control unit 100, including on, off and other control of sensors 112, 114, 116, 118 and/or 122, is preferably under the control of PTC processor 120 and the central control facility 70.

Similarly, RFID devices 500, wayside, switch and track monitors 310, 320, 330 may also include processors 120, P, as indicated and illustrated by the letter "P" therein, that process received and/or sensed data to provide output data to PTC processor 120 for combination and/or integration with other data relating to track way conditions. Data from RFID devices 500, wayside, switch and track monitors 310, 320, 330 preferably includes location data representing the respective locations thereof, e.g., by predetermined location data stored in a memory of and/or by a GPS locator of wayside, switch and track monitors 310, 320, 330.

Further, the processing, combination and/or integration of data may be performed in any order that is convenient, e.g., for efficient use of processor 120 and any processors associated with any of sensors 112, 114, 116, 118, 122, 124, 310, 320 and/or 330. Similarly, time-tagging and/or geo-tagging of sensor data may be performed by PTC processor 120 associating time and/or location data from GPS device 132 and/or inertial navigation device 134 with data from sensors 112, 114, 116, 118 and/or 122, or by such time and/or location data being provided to sensors 112, 114, 116, 118 and/or 122 and associated with the data produced thereby, or by any or all of sensors 112, 114, 116, 118 and/or 122 including a time and/or locating device. Data and other communications transmitted to the central control facility 70 include the geo-tags and time tags. Where plural devices each include a time reference, it is preferred that the time references of all devices be synchronized to a time standard of known accuracy, e.g., to the time standard of GPS device 132 and/or to the central train control facility 70.

FIG. 4 is a schematic flow diagram illustrating operation 400 of the example embodiment of the positive train control system 100 of FIG. 3. Process 400 commences with an initialization 405 so that all elements of and/associated with positive train control unit 100 are in predetermined known operating states, e.g., all of sensors 110 are turned on and to a predetermined sensing range and/or mode, and processor 120 is likewise initialized so that the controlling computer program thereof commences operation at a known state. RFID data acquisition 410 and sensor data acquisition 420 preferably are performed in parallel, and preferably independently, for each of the RFID devices 124 and for each of plural sensors 110, identified in the flow chart 400 as sensor #1 through sensor N.

In some embodiments, the sensing and data outputting cycles of the RFID reader/detector 124 and of plural sensors 110 may be made substantially contemporaneous in time so as to obtain plural data sets from different sources at substantially the same time, thereby to have substantially if not exactly the same geo-tagged location and time stamp. In other embodiments the sensing and data outputting cycles of the RFID reader/detector 124 and plural sensors 110 may be offset in time from each other so as to reduce a peak demand for data processing by processor 120 in a particular embodiment, it being recognized that the differences in the timing of the data from the plural sensors would be on the order of only a few seconds so that slight differences in geo-tagged locations and time stamps do not represent a material difference in the sensed data and/or a difference cannot be correlated with the data from others of the RFID reader/detector 124 and the plural sensors 110.

RFID data acquisition 410 commences with the reading 412 of one or more RFID devices 500 that are embedded as a set in close proximity to each other at a single location along the track way 60. Typically, RFID reader/detector 124 repeatedly transmits an interrogating signal at regular intervals that are relatively closely spaced in time, e.g., about 1,000 to 1,100 or more times per second. The reading 412 of an RFID device 500 includes the transmitting of an interrogation signal by RFID reader/detector 124 that impinges upon an RFID device 500 and the RFID device responding to the interrogating signal by transmitting the location data, track data and unique identifier that are stored and/or preprogrammed therein.

The data received 412 from each RFID device is verified 414 for completeness and consistency, and is also verified 416 for completeness and consistency with track map data that has been stored in positive train control unit 100, all as described above. Because the RFID data received from RFID devices 500 includes location data that precisely represents the location at which it the RFID device 500 is embedded along track way 60, the RFID device data is effectively self geo-tagging, and so the data geo-tagging is not shown as a separate step in process 400, although it could be. Where correlation of location data from RFID device 500 with location data obtained from another location sensor 130, e.g., GPS sensor 132 and/or inertial sensor 134, of positive train control unit 100 is made, the location data from both sources may be included in the geo-tagging data. Following the verification steps 414, 416, the data and results thereof are reported 418, e.g., transmitted 418, to central control facility 70 via communication system 90.

For each of plural sensors #1 to N the respective operating sequence 420-1 through 420-N is substantially similar, although there may be differences in the details due to the particular configurations and capabilities of the various plural sensors 110, as is known to one of ordinary skill in the art relating to such sensors 110. First, the sensor acquires data 422-1 to 422-N and preferably associates location data and time data at the time of each sensing with the sensed data, thereby to geo-tag and time tag the sensor data. Alternatively, associating location data and time data with the sensed data can be done after the time of each sensing provided that the intervening time period is known or is inconsequentially small so that the appropriate location data and time data for the time of sensing can be computed, thereby to appropriately geo-tag and time tag the sensor data.

For each of sensors #1 to N the sensed data produced thereby may then be analyzed 424-1 to 424-N to identify certain features of that data, e.g., to identify the track or track way 60 which will stand out because it changes little between successive sensings, e.g., the track 60 remains generally in front of the train and so will be in substantially the same place in the sensed data and will change little between successive sensings, while the surrounding environment will change to a greater extent as the train 50 moves. Moreover, the faster the train moves, the more substantially the surrounding environment will change, thereby making it easier to distinguish the track from its environment which is consistent with the desired sensing because the risk, e.g., due to sight line shortening and braking distance increasing, increases with the speed of the train.

Alternatively, and optionally, processor 120 may adjust the rate at which plural sensors 110 operate to sense and analyze 420 data as a function of the speed of train 50, e.g., as a function of the planned speed profile as defined by a train routing order, or by the speed limits as defined by the track map and the present location data, or by the measured actual speed of the train, or by a combination thereof. The operating rate of one or more of plural sensors 110 could be increased as the speed (as planned, defined and/or measured) increases and could be decreased as the speed decreases.

Once sensor #1 to N identifies 424 from its sensed data the track in its field of view, it then analyzes the data to detect 426-1 to 426-N whether there is an object or other anomaly that is on or near to the track, or optionally, over a sequence of sensed data to detect 426-1 to 426-N whether there is an object that is moving towards the track. Each sensor #1 to N then outputs its sensed and analyzed data 440 and returns to repeat 408 the its data acquisition and analysis operating sequence 420 to sense and analyze data sensed at the next location and time. Thus, each of plural sensors 110 senses and provides a sequence of data sets that are geo-tagged and time stamped for correlation to the location and path of travel of the train 50.

Each geo-tagged and time stamped data set, and data relating to any object or other anomaly that was detected thereby, outputted by plural sensors 110 is combined and integrated 440 with each other, with the data received 410 from RFID devices 500, and with track maps, speed limits, location data, and/or train routing orders, e.g., as were received 300 to define the predetermined expected location and timing of train 50 along its intended route. The combined, integrated data 440 is reported, e.g., transmitted 442, to the central control facility 70 where it is also processed as described below.

The combined integrated 440 data is combined 450 with track data, e.g., a track map, and with train operating data received 452, e.g., from the control system 220 and/or monitor 230, of the train 50, which typically would include data relating to throttle setting and speed, and brake application, as sensed and determined by the systems 220, 230 of the train 50. The combined integrated 440 data is also combined 450 with anomaly data received 454 from external monitors, e.g., wayside monitors 310, switch monitors 320 and track monitors 330 and their respective sensors 312, 322, 332.

The combined, integrated data, 440 and/or 450, if configured and presentable so as to be human readable, would for any given time be comparable to an annotated map of the track way with the train location, speed and direction thereon, or for a period of time would be comparable to a video map display of the track way having the train moving thereon, annotated with its location, speed and direction. Operator alert device 210 of train 50 optionally comprises and/or includes a viewable monitor, e.g., a computer or video display, on which such combined data 450 is displayed 456, either as one of plural available displayable data displays and/or along with an other data display.

Hazards, e.g., an object on the track or another track anomaly, represented by the combined integrated data 440 and/or the combined integrated data 450 are identified and processed to correlate the data, to identify and quantify 460 the hazard, e.g., as to the seriousness and likelihood of the hazard occurring, which is helpful in determining the action to be taken and whether or not it is a critical, e.g., safety related, action.

While the foregoing description of operating process 400 includes a number of different steps, some of which are shown in a stage or sequence (e.g., 410, 420), that are described in an order, that order is not necessary or required to be followed. The various steps and stages 408-460 thus far described can and may be performed an any suitable order, e.g., any order that produces the end result of a combined and integrated data set 450 generated from the various sensors and monitors 124, 410, 420, 310, 320, 330, 220, 230 which in the illustration occurs at the output of step 450 and before the correlating data, identifying and quantifying hazards step 460.

For example, the detecting of anomalies 426 may be performed by the processing of sensed data in any or all of sensors #1 to N or by processing sensed data from any or all of sensors #1 to N in processor 120. Similarly, external data and anomaly data from various sensors and monitors 310, 320, 330, 220, 230 may be combined and integrated in step 440, in step 450, in step 460, or equivalently in a single or different step, as indicated, e.g., by the dashed arrows in the path designated by encircled letters A.

The combined, integrated correlated data and any identified hazards 440-460 are then utilized in positive train control unit 100 on train 50 for the operation thereof, as well as being transmitted and reported 462 to central control and/or operations location 70, e.g., a central control facility 70, which exercises overall operation and management of the track way system 60 and of the trains 50 thereon. It is important to note that operation of the positive control system 100 is partly performed by positive train control unit 100 on train 50 and is controlled, overseen and/or superceded by data from or communication with central control or operation location 70.

Short range communication with external wayside monitors 310, switch monitors 320 and track monitors 330, if available, is the only communication external to positive train control unit 100 on train 50 other than communication with central train control facility 70 that is utilized in the operation thereof, and even that is not necessary to the essential operation of positive train control unit 100 on train 50. Data from such monitors 310-330 in effect allows maintaining a looking forward distance that in some locations may be greater than the direct forward looking line-of-sight range of sensors 110 of positive train control unit 100, e.g., because the effects of physical obstructions, e.g., trees, curves and hills, can be effectively eliminated.

Thus, loss of communication with external monitors 310-330 if acted upon might only result in a proportional speed reduction for train 50, and only if needed to maintain the same degree of safety under positive train control protocols as with such communication. Primary communication with central control facility 70 via communication system 90 includes redundant communication elements 92 providing reliable, redundant and alternative communication paths and links. This redundancy providing alternative communication paths and communication links substantially eliminates a complete loss of communication which would cause the shutting down of all or of a portion of the railroad, e.g., with all trains stopped for safety or proceeding at an extremely slow safe speed, thereby to increase the operating time and efficiency of the system.

The correlated 460 data and identified hazard data is transmitted 462 and/or otherwise reported 462 to a central control or operating location 70 for controlling, monitoring and management of the trains 50 operating on track ways 60. While transmission of the data acquired on train 50 to the central control facility 70 is shown as occurring as several different steps of process 400, e.g., as steps 418, 442, 462, 484, as preferred, the data can be transmitted as additional or fewer steps of process 400 as may be necessary and appropriate given the particulars of a particular track way system 60 or desired operating protocol. Preferably, central control facility 70 processes the data transmitted 418, 442, 462, 484 to it to analyze and control the operation of trains 50 on track way system 60 by transmitting train control and/or routing orders to the various trains.

In the descriptions herein, any operation on the data described as being performed by positive train control unit 100 can and typically is also performed by central train control facility 70 and vice versa. In certain embodiments, e.g., particularly those intended for developing nations where the resources available for positive train control are limited, the on-board equipment of positive train control unit 100 may be minimized and all of the data acquired by positive train control unit 100 is reported/transmitted to central control facility 70 whereat it is processed as described herein relative to process 400, e.g., to combine and/or integrate data, identify track conditions, anomalies, train operating conditions, hazards, conditions requiring an action to be taken, and the like.

The combined, integrated correlated data 440, 450, 460 and any identified hazards 440-460 are then utilized in positive train control unit 100 on train 50, and/or in central train control facility 70. To that end the integrated correlated data 440-460 is tested 470, 480, e.g., compared 470, 480, to predetermined limits established to determine whether the integrated correlated data is within or is outside of those limits. In a first instance, the integrated correlated data is compared 470 with a first predetermined limit, typically a limit indicative of a relatively lower risk, to determine if a warning action 472 should be taken, and if yes 470-Y, then alerts and warnings are provided 472 to the train operator, e.g., train crew. Such warnings may be by one or more visual and/or audible signals at the train crew work stations, e.g., in the train control cab for the train engineer and assistant, and/or at a fixed control and/or reporting station 340 or tower 340. If the data is within the predetermined first limit, the path 470-N returns operation 400 to repeat 408 the process 400.

In a second instance, the integrated correlated data 440, 450, 460 is compared 480 with a second predetermined limit, typically a limit indicative of a relatively higher risk, to determine if a positive train control action 482 should be taken, and if yes 480-Y, then train controls for speed and/or braking are activated 482 to reduce the train throttle setting, apply the brakes, or both, including possibly an emergency application of the brakes where, e.g., an object is on the track, or a switch is in the wrong position or is not properly closed, or a switch position is not consistent with the train routing order, or the rails are damaged or distorted. In addition, alerts and warnings to the train operator and/or crew are provided 472 or continued 472. If the data is within the predetermined second limit, the path 480-N returns operation 400 to repeat 408 the process 400.

Central control facility 70 receives data transmitted 418, 442, 462, 484 from process 400 at several times in that process, e.g., after steps 416, 440, 460, 482, and is configured to process such received data to evaluate the operating situation and safety of the operations of trains 50 on track way system 60, to test such data against one or more predetermined limits, and to generate alerts and warnings as may be indicated thereby.

In addition, central control facility 70 may issue notifications, alerts, warnings and/or commands 464 to device 220 of positive train control unit 100 to directly instruct or command 472 the train crew to take certain actions, e.g., to adjust the speed or apply the brakes, and/or to have the train control equipment 220 on board the train 50 to automatically initiate such actions independently of the train crew.

It is noted that not only are sensors #1 to N optional, but when present, the data sensed thereby may be analyzed by processor 120 and may be transmitted to the central control facility 70 either as sensed data or as sensed and analyzed data. Alternatively and/or additionally, the sensed data may be analyzed 424, 426, 440, 450, 460 by a central processor in central control facility 70, and may be employed to generate and transmit to train 50 control commands including alerts and advisories, as well as inputs to the on-board train controls 220 to control the engine and/or activate the brakes.

In a rudimentary implementation of the described system, analysis and control could be centralized at control facility 70, however, this makes communication between each train 50 and central facility 70 of great importance to safe operation. Hence it is preferred that certain basic analysis and control steps, e.g., determining location on track way 60, speed monitoring and control, and at least basic anomaly detection, be performed by a processor 120 on-board trains 50, so that positive train control can be maintained even at times when communication between central facility 70 and train 50 may be weak, error prone and/or unreliable, or even absent.

Process 400 typically operates rapidly, repeating every second or every few seconds, so that the operation and detection of possible hazards is essentially continuous, e.g., being relatively short in time as compared to the movement of train 50 and to the rate at which any change therein may be effected. In a typical embodiment, process 400 is performed in about one second and repeats about every second. Detection by various ones of the sensors 110, 312 can be, and preferably are, in about the same time frame, e.g., taking as little as about 15 frames or one second for an image sensor, depending upon the size and distinctness of the object to be detected—a vehicle will be easier to detect than would a person or an animal of modest size. If desired, the repetition rate of process 400, as well as of the detection processes thereof, may be varied with to train speed, e.g., the faster the train is moving the more rapid would be the repetition rate of the operating cycle of process 400 and the slower the train is moving the more the repetition rate of the operating cycle of process 400 could be slowed.

Figure 6A:
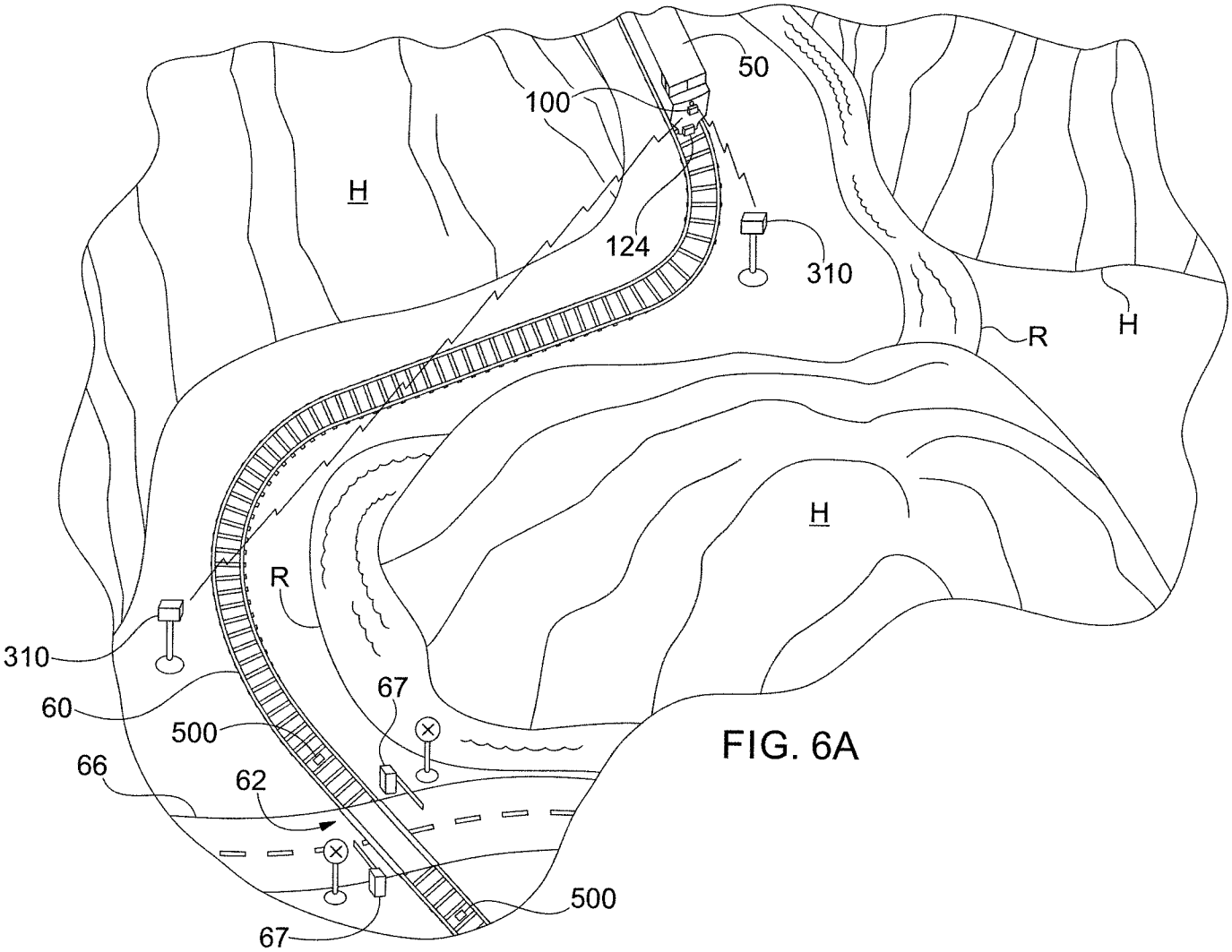
FIGS. 6A and 6B are schematic diagrams of an example embodiment of positive train control RFID devices and wayside monitors located along a track way.
Figure 6B:
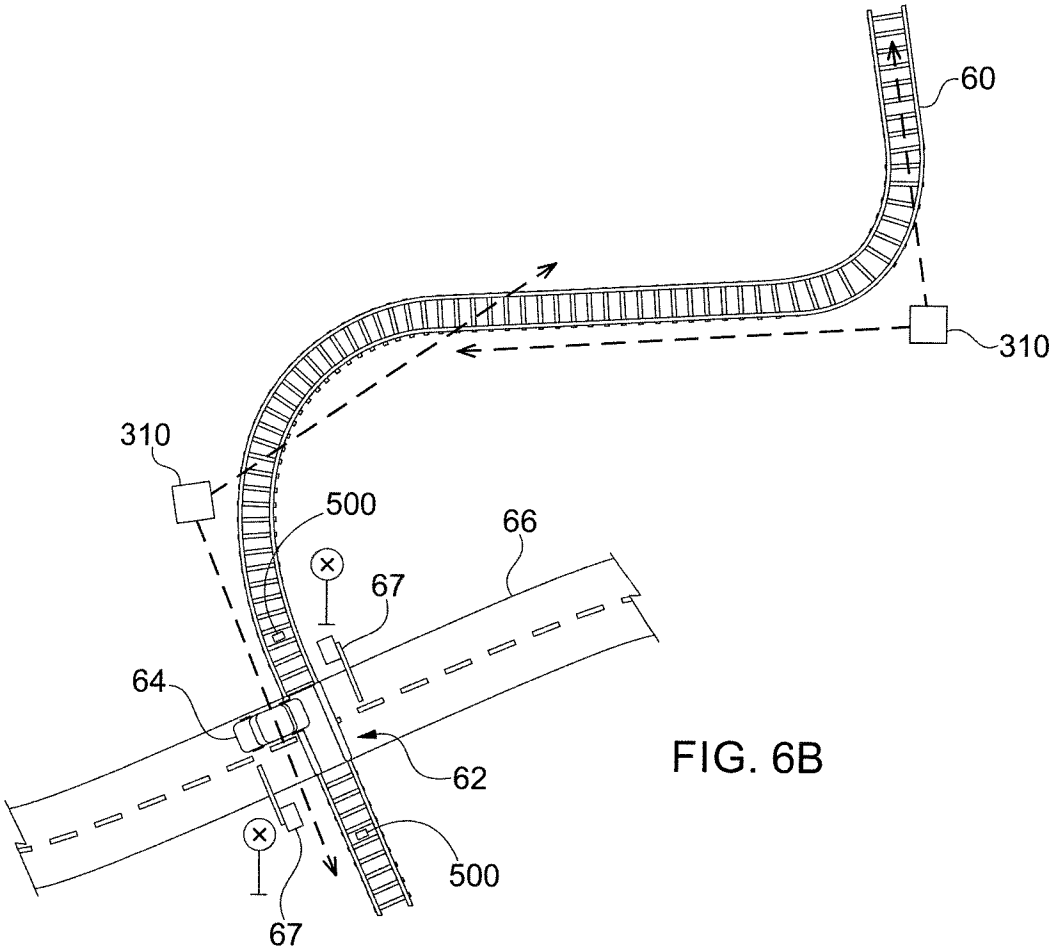
Figure 7:
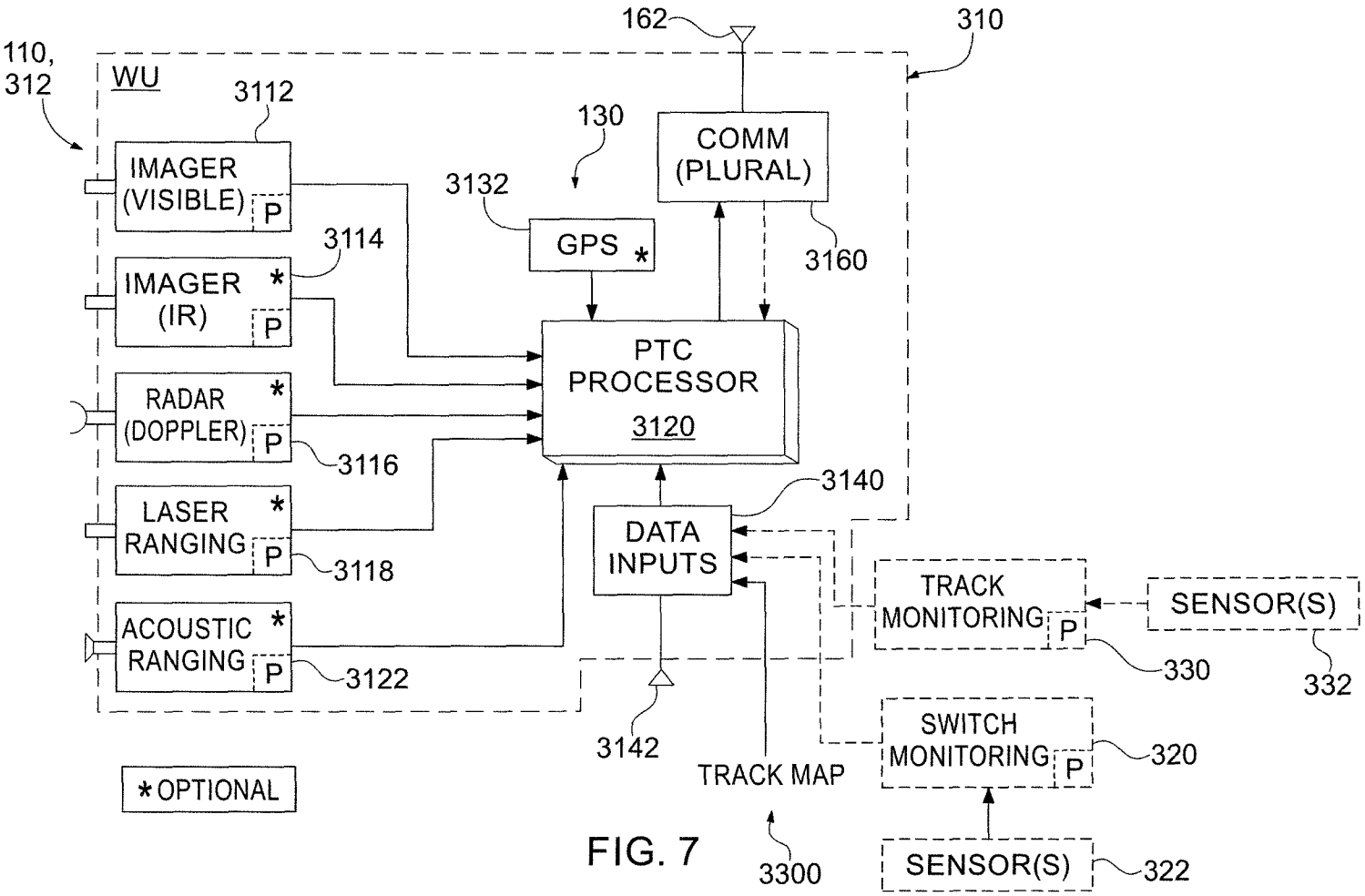
FIG. 7 is a schematic block diagram of an example embodiment of a positive train control wayside monitor unit suitable for mounting along a track way.

FIGS. 6A and 6B which are a schematic diagram of an example embodiment of positive train control wayside monitors 310 and RFID devices 500 located along a track way 60 and a schematic plan view thereof, respectively; and FIG. 7 is a schematic block diagram of an example embodiment of a positive train control wayside monitor unit 310 suitable for mounting, e.g., along a track way 60. Wayside monitor unit 310 is similar to positive train control unit 100 in many respects and may be considered as a reduced complexity version thereof. Consider that a train mounted positive train control unit 100 need take into account the ever changing geometry of the track ahead of the train as well as the operating condition and status of train engine and braking systems, none of which are of concern for a wayside monitor 310 that is mounted in a fixed location proximate a track way 60 which is itself in a fixed configuration.

The example track way 60 illustrated in FIG. 6 is in an example topography wherein the track way 60 has several curves and/or hills and/or is shielded by topographical features, e.g., hills, mountains and/or tunnels, so that the distance forward of train 10 that is within the fields of view of sensors 110 of positive train control unit 100 thereon is substantially reduced. Certain sensors 110 have straight line sensing and range views and cannot "see" or sense around obstacles. To reduce blind spots resulting therefrom, one or more wayside monitor units 310 may be provided along the track way 60 in locations wherein the fields of view of their sensors 110, 312, can be put to good and efficient use.

For example, on curves a wayside monitor 310 may be located radially outside of the curved track way 60 so as to have longer sensor 110, 312 ranges than could be obtained from locations on the track way 60, e.g., by a positive train control unit 100. On hills a wayside monitor 310 may be located, e.g., near the crest of a hill or near the low point of a valley to the same end. Both the distance from track way 60 and the height at which wayside monitor 310 is mounted may be selected to gain an improved sensor 110, 312 field of view and range. Wayside monitors 310 at such locations may include sensors 110, 312 that have respective fields of view in substantially different directions so as to provide coverage of the track way in both directions from the location of wayside monitors 310, as indicated by the dashed arrows in FIG. 6B.

In the illustrated example, one or more wayside monitors 310 is located near each of the oppositely curved portions of track way 60 that define an "S" shaped curve of track way 60 so as to provide substantially complete sensor 110, 312 coverage thereof over a desired sensor range, e.g., of 100 meters to 2000 or 5000 meters, in one or more directions, particularly where train mounted positive train control unit 100 cannot provide a complete picture.

In the illustrated example, a wayside monitor 310 is located proximate a crossing, e.g., a grade crossing 62 or a track way crossing 62, within the sensing range and fields of view of its sensors 312 for monitoring crossing 62, principally for detecting any object or obstruction, e.g., a crossing vehicle 64 or train 50, that may be on or crossing track 60. Such locating of wayside monitor 310 is most commonly and importantly at locations at which the crossing 62 is not visible to an approaching train 50, 52, e.g., due to track way curvature and/or obstructions to the field of view of personnel and sensors 110 associated with train 50, 52, and may also be beneficially employed at other locations to reduce the danger arising due to reduced visibility due to darkness, rain, fog and the like.

For example, a vehicle 64 may be operating on roadway 66 which crosses track way 60 at grade crossing 62 which may or may not have electrical crossing signals and/or gates 67. One or more sensors 110, 312 of wayside monitor 310 detect vehicle 64 and relay data representative of an object being on the track way 60 during the period of time that vehicle 64 is, e.g., within the right of way of track way 60. The data representing presence of vehicle 64 is relayed and/or transmitted by communication device 3160, e.g., to positive train control units 100 that are proximate wayside monitor 310, e.g., approaching crossing 62, and/or preferably to a central monitoring facility 70.

Example wayside monitor 310 sensors 110, 312 may include one or more of visible band imagers 3112 producing either sequential still images or video images, one or more infrared (IR) band imagers 3114 producing either sequential still IR images or video IR images, one or more radar imagers 3116 including Doppler radars and other types of radars 116, 3116, one or more laser ranging devices 3118 and/or one or more acoustic ranging and/or sonar ranging devices 3122. Sensors 3112. 3114. 3116, 3118 and/or 3122 preferably, but need not, correspond to like sensors 112, 114, 116, 118 and 122 of positive train control unit 100.

The inclusion of plural and/or redundant sensors 110, 312 has an economic cost that may not be affordable in developing countries. In a low-cost embodiment of a wayside monitor 310 suitable for the limited available resources in developing nations, a visible band imager 3112 may be the preferred, and possibly the only, sensor 110, 312 employed in wayside monitor 310, along with at least a communication elements 3160.

Data sensed by sensors 110, 312 is communicated to processor 3120 (which generally corresponds to processor 120 of positive train control unit 100) over cables, e.g., electrical cables and/or optical fiber cables, which processes the sensor data to determine the track conditions within its fields of view. Determining whether any dangerous or hazardous condition exists on track way 60 is then performed, either by the wayside monitor processor 3120 or at central control facility 70 from the sensor 110, 312 data transmitted thereto from wayside monitor 310. Based thereon, data transmitted to positive train control unit 100 either from wayside monitor 310 or from central facility 70 may be directly applied or may be combined with positive train control unit 100 sensor 110 data on a train 50 by processor 120 thereof to, e.g., initiate appropriate actions to signal the train crew and/or exercise control over train 50.

The distance over which the various sensors 110, 312 preferably sense can range from relatively close range, e.g., 10-50 meters ahead up to one, two or five kilometers ahead, thereby to encompass sensing over a length of track that is within the viewing range and field of view of that wayside monitor 310. The respective sensor fields of view preferably extend over a range of elevations (vertical angles) and a range of widths or azimuth (horizontal angles) sufficient to sense the track within their fields of view including the variations in grade and/or curvature known to be permitted for sensing by such sensors 312. In some cases, one sensor 312 can sense over the entire ranges of distance, elevation and azimuth, and in other cases, more than one sensor 312 may be required to sense over the entire ranges of distance, elevation and azimuth.

The geographic location of wayside monitor 310 may be obtained by one or more GPS sensors 3132 thereof or may be provided as one of the data inputs 3140, 3142 received from an external source, e.g., manual data input, as may be desirable. In a typical implementation, accurate location data is stored in wayside monitor 310 from a programming device, which could be a memory card, a USB drive, a SIM card, or other storage device. In any event, such data is available for use by processor 120, 3120 as above.

All data produced by sensors 110, 312 is associated with the location of wayside monitor 310 provided by location determination 130, 3132 or by stored location data at the time the data was acquired, and is also time tagged, e.g., by processor 3120 so that all sensor data is both geo-tagged and time tagged for facilitating its being cross referenced to other data, both similar data and dissimilar data, for storing and processing such data within wayside monitor 310, and by any positive train control unit 100 to which it may be transmitted, and at a central location to which such data may be transmitted 160, 162.

Optionally, switch monitors 320 and/or track monitors 330, if any (shown dashed), that may be located nearby to wayside unit 310, e.g., within communication range, may communicate their data to and via data inputs 3140, 3142 and/or via communication device 3160 of wayside unit 310 for combination with data produced by wayside unit 310 and/or for transmission by wayside unit 310, e.g., to a train 50 and/or to a central facility 70.

All elements of wayside unit 310 may be and preferably are similar to corresponding elements of positive train control unit 100 as described herein, and may function, and preferably do function in similar manner thereto. Similar elements of wayside unit 310 may bear the same item number as their counterparts in positive train control unit 100 preceded by the numeral 3, e.g., processor 3120 is similar to processor 120, and may include one or more processors 3120, P as described above in relation to processor 120. Where cost is an important consideration, the commonality of configuration and of the devices employed by positive train control unit 100 and by wayside monitor 310 can result in lower procurement cost and can facilitate installation and maintenance efficiency and simplify personnel training.

Figure 8:
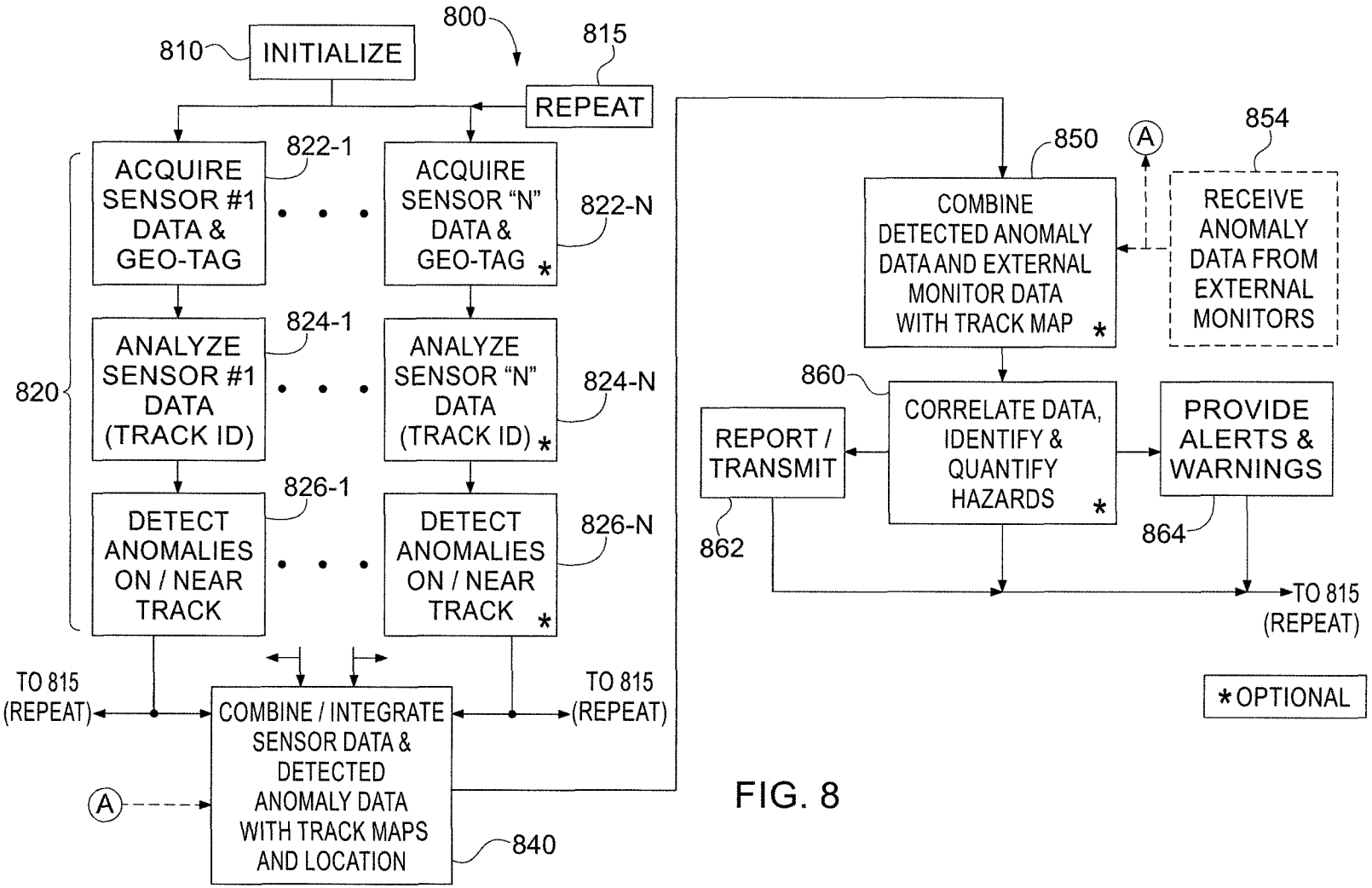
FIG. 8 is a schematic flow diagram illustrating an example operation of the example embodiment of FIG. 7.

FIG. 8 is a schematic flow diagram illustrating an example process or operation 800 of the example embodiment of the positive train control wayside unit 310 of FIG. 7. Operation or process 800 is in many aspects substantially similar to process 400 and the variations thereof described above in relation to positive train control unit 100 and RFID reader/detector 124. In particular, the operation 800 of items 810 through 860 and 864 are substantially similar to that of items 405-460 and 472, 484 of operation process 400, with the initial digit of the item numbers of equivalent steps being an "8" rather than a "4."

Initialization 810 includes, e.g., storing in wayside monitor 310 geographic location data for the location at which it is installed with accuracy sufficient to identify its location adjacent track way 60, typically along and within the right of way 60 thereof. Location data may be obtained by GPS or other technical apparatus, e.g., either GPS 130, 3132 if included in wayside monitor 310 or GPS apparatus external thereto, or by reading a closely adjacent RFID device or devices 500 if any, or by any other suitable means, e.g., using a survey and map. Location data may be uploaded to wayside monitor 310 from an external storage device, e.g., calibration equipment or a thumb drive or other digital storage device, either in a central facility, e.g., facility 70, or in the field, e.g., where wayside monitor 310 is installed. Initialization 810 may also include aiming and/or aligning any sensors 312, e.g., a visible imager 3112, of wayside monitor 310 and verifying that communication 90, 92 between wayside monitor 310 and central facility 70 is established and is operating within predetermined parameter specifications, e.g., signal strength and bandwidth, and/or other technical parameter limits.

Sensed and/or processed data produced by operation 820 of one or more of sensors 312 of wayside unit 310 which is fixed at a predetermined location may be and typically are less complex than that for process 400, because the field of view and range of the one or more sensors 312 of a wayside unit 310 are fixed and can be predetermined because the location and orientation of wayside unit 310 and its plural sensors 312 are known and are fixed. For example, once the track way 60 is identified 824, it can at least be preset if not fixed for the analysis of sensor data thereafter, and so while object and/or other anomaly detection 826 may require the most processing effort, that effort is substantially less than is required for positive train control unit 100 where the scene viewed by its sensors 100 changes as the train 50 moves.

Moreover, because the location of wayside monitor 310 is known and fixed, the track map may be defined for the relatively short length of track that is in the field of view and range of sensors 312, or may simply be location data, e.g., location data for a grade crossing 62 being monitored. Moreover, RFID control devices 500, if any are proximate to a wayside monitor 310, may be the source of location data therefor and are at a boundary 82 between adjacent blocks 80 of track way 60 and so the sensors 312 of wayside monitor 310, e.g., a visual imager 3112 thereof, may be employed to provide sensor data representative of any train or trains 50 within its view to central facility 70, whereby that sensor data may be correlated or otherwise utilized to confirm the location data transmitted from train 50 when its RFID reader/detector 124 senses or detects an RFID device 500 embedded in track way 60 and transmits that data to central facility 70.

The combined integrated 840 data and detected object data is combined 850 with anomaly data that may be received 854 from external monitors, e.g., other wayside monitors 310, or nearby switch monitors 320 and track monitors 330 and their respective sensors 312, 322, 332, if any. Item 854 is shown as dashed because there may or may not be any external monitors 310, 320, 330 associated with and/or proximate to the wayside monitor 310 performing process 800.

While the foregoing description of operating process 800 includes a number of different steps or stages that are described in an order, that order is not necessary or required to be followed. The various steps and stages 815-860 can and may be performed in any suitable order, e.g., any order that produces the end result of a combined and integrated data set generated from the various sensors and monitors 820, 310, 320, 330 which in the illustrated example occurs at the output of the correlating data, identifying and quantifying hazards step 860.

For instance, the detecting of objects 826 may be performed by the processing of sensed data in any or all of sensors #1 to N that may be present or by processing sensed data from any or all of those sensors #1 to N in processor 3120. Similarly, external data and anomaly data from various sensors and monitors 310, 320, 330, may be combined and integrated in step 840, in step 850, in step 860, or equivalently in a single or different step, as indicated, e.g., by the statement in step 850 and the dashed arrows in the path designated by encircled letters A.

The sensor data and/or the combined, integrated correlated data and any identified hazards 840-860 are transmitted and reported 862, e.g., to a central control and/or operations location 70. It is noted that processing of sensor 312 data, e.g., in processing steps 824, 826, 840, 850 and 860, may be performed by a processor of wayside monitor 310 or the sensor data may be transmitted to central facility 70 whereat processors perform the processing, e.g., in processing steps 824, 826, 840, 850 and 860, thereof.

In addition, the combined, integrated correlated data and any identified hazards 840-860 are preferably transmitted using local communication links for a distance from wayside unit 310 sufficient to provide 864 hazard data alerts and warnings to positive train control unit 100 of an approaching train 50 indicating whether there is a hazard, e.g., an object on the track or a switch or track anomaly.

Example embodiments for a typical example switch monitor 320 and for a typical example track monitor 330 are described in U.S. Pat. No. 9,434,397 entitled "Positive Train Control System and Apparatus Therefor" of Kevin K-T Chung et al, which is hereby incorporated herein by reference in its entirety. Switch monitors 320 and/or track monitors 330 may provide quantitative representations of the physical condition and stat or switches and tracks and/or may provide a simple "go/no go" indication as to whether the switch and/or track is suitable for operational use, e.g., a switch monitor 320 may have a simple physical electrical contact that closes when the closure rail abuts the stock rail, or any equivalent, e.g., a magnet and reed switch.

In summary, an example switch monitor 320 senses the position of the switch rail and provides a separate independent positive indication that the switch has completely transferred to supplement the conventional switch interlock signaling and optionally, but preferably, be in communication with the electrical interlock signaling electronics to improve the integrity of the indications it provides. Any condition where the physical spacing and/or alignment and/or completeness of a transfer of a switch rail of a track way is not within a prescribed configuration and/or within tolerance is included in what is referred to herein as an anomaly of the track way.

As noted herein, switch monitor 320 includes one or more communication transmitters that communicate switch data to positive train control units 100 attached to trains 50, to wayside monitors 310, and/or to a central monitoring location 70, thereby to make the sensed data directly or indirectly available to a train 50 for evaluating the need for a safety action to be taken.

In summary, an example track monitor 330 senses and provides a separate independent positive indication that the physical spacing and alignment of the rails of track way 60 are within prescribed tolerances. Any condition where the physical spacing and/or alignment of a track way and/or of the rails of a track way is not within a prescribed configuration and/or within tolerance is included in what is referred to herein as an anomaly of the track way.

As noted herein, track monitor 330 includes one or more communication transmitters that communicate track data to positive train control units 100 attached to trains, to wayside monitors 310, and/or to a central monitoring location 70, thereby to make the sensed data directly or indirectly available to a train 50 for evaluating the need for a safety action to be taken In a typical embodiment, it is preferred, that at least a combination of plural sensors selected from among the suitable visible and infrared imaging systems, laser ranging systems, acoustic ranging systems, and/or Doppler radar and ranging systems, are employed for detecting the presence of objects and other anomalies within the field of view and range of the sensors, which preferably includes ranges of about 100 meters up to 5000 meters (5 Km), as illustrated in FIG. 5, to allow for adequate time for detection, processing and for initiating warnings, braking, stopping, emergency stopping, and other appropriate corrections and actions, whether by an operator or by automated action. It is recognized, however, that the preferred combination may not be practical or affordable under certain circumstances, and so a combination of sensors including at least RFID reader/detector 124 and a visible band imager 112 would be preferable under such circumstances.

An example of a suitable RFID device 500 includes UHF metal tag (Model: RCO 8009) made by Shenzhen RICH RFID Technology Co., Ltd (www.rc-RFID.com, www.passive-RFID-tags.com); High Temperature Resistant Anti-Metal Tag, Model VT-98, made by Shenzhen Vanch Intelligent Technology Co., Ltd.; Anti-metal RFID UHF tag, high temperature resistance Model G2XM, available from amazon.com; High Temperature RFID anti-metal UHF tag for car made by D & H SMARTID CO., Ltd. located in Guangzhou, China, and many others.

Preferably the RFID device 500 is contained in a sealed container or enclosure, e.g., a high temperature capable, "metal-water capable" UHF RFID tag or unit, that may operate properly even when wholly or partially submerged, and/or subjected to extremes of hot and cold outdoor temperatures. Different RFID tag constructions and engineering will provide different results in the lateral spread at the same reader distance above the embedded in-ground RFID device 500 that the device can be read efficiently. Those that have the widest range at 2-3 feet above ground are preferred.

An example of a suitable RFID reader/detector 124 includes one or more UHF antenna, e.g., a UHF patch antenna, that is mounted to the underside of the first carriage, typically a locomotive or engine, with the sensing and detecting electronics being installed inside that carriage, e.g., in a control cab thereof, where the sensed data, e.g., location data, track data and block data, may be displayed e.g., on a monitor or a tablet computer, for informing the operator. A suitable reader/detector includes: UHF long range reader, model: FX-0703, made by Fengxing Industrial Development Co. Limited, located in Shenzhen, China; type CF-RU5112 UHF 15 meters long range passive RFID vehicle identification RFID reader, made by Shenzhen Chafon Technology Co., Ltd.; located in China (www.chafon.com); UHF Long Range Reader type LRU1002, made by FEIG Electronic GmbH (www.feig-electronics.com); and many others.

While RFID antennae are sometimes integrated into the readers, separate reader and antennae are also applicable. YongKaiDa RFID antenna UHF reader 15 m 12 dbi long range passive RFID reader, made by Shenzhen Yongkaida Technological Co., Ltd., (www.szykdcard.com); UHF outdoor RFID reader integrated 12 dbi linear polarization antenna/15 m UHF epc gen2 RFID reader antenna long range rs232, Wiegand 26/34, model YR 8001, made by Shenzhen Invelion Technology Co., Ltd; and similar devices available from many other sources.

A suitable operator alert device 210 comprises, e.g., a robust industrial computer with flash memory hard drive, color monitoring touch-screen, a strobe light and a sounding beeper and speaker that is operable to interface with all of the train sensors (e.g., fuel, vibration, proximity switch, etc.) and positive train control devices (e.g., Doppler-Optical-IR imaging cameras; RFID reader devices, etc.), and has incorporated for this application operating with applicable software developed specifically for this application. The PTC-3000 is a model developed and manufactured by AVANTE International Technology, Inc. of Princeton Junction, N.J., for this operator alert device 210 to provide both optical (strobe light and flashing color screen) and audio (sound generating beeper and speaker) alerts and warnings. Alternatively, commercially available laptop or tablet computers, e.g., an Android, Windows 8 or 10, iOS based laptop or tablet computer, such as a Microsoft Surface Pro, a Samsung Galaxy, a Dell Canvas, or an Apple iPad, could be configured by suitable application software to serve as an operator alert device 210.

An example of a suitable visible imager or sensor 112 includes, e.g., a NORIRHJK-2C CCD and thermal surveillance system, which is available from North Night Vision Science & Technology Group Corp, located in Yunnan, China, or 5.5KM & 3.8KM thermal image cameras made by Chengyu Intelligence Technology Co., Ltd. located in Changzhou, Jiangsu, China.

An example of a suitable infrared imager or sensor 114 includes, e.g., model JIR-3031 and JIR-3031A digital cameras available from JIR company located in Hubei, China, and through Alibaba.com. These digital IR cameras have an about 37°×28° field of view, can sense through fog and precipitation and without visible illumination, and operate from a 12-24 VDC power supply (as may be available in a vehicle).

Another example includes the types IP-ELR320, IP-ELR775 and IP-ELR775X night vision IR camera system which can detect a car-size object at respective ranges of 2500 meters (day) and 1500 meters (night), 5000 meters (day and 2500 meters (night, and 8000 meters (day) and 2500 meters (night), can detect human-size objects at respective ranges of 1500 meters (day) and 900 meters (night), 2000 meters (day) and 1200 meters (night), and 4000 meters (day) and 1500 meters (night), and can employ an 808 nm IR illuminator, and are available from Kintronics, Inc., located in Ossining, N.Y.

Further examples include the Sigma Series PTZ laser diode IR illuminating and imaging equipment available from Ascendent Technology Group of Cranbrook, British Columbia, Canada, and the Lynceus™ ISN and ISA series of vision and IR laser illuminated night vision camera systems available from Kaya Optics, Inc. located in Tokyo, Japan.

Examples of a suitable Doppler radar sensor 116 include, e.g., types KR-1338C and KR-1668C marine radars available from Bochi of Changqing, China, and model S66 radar available through Alibaba.com.

An example of a suitable laser ranging sensor 118 includes, e.g., AIGERZYT-LLS-81-X, which is available from Beijing Zhong Yuan Tong Science & Technology Co., Ltd. located in Beijing, China.

An example of a suitable acoustic ranging sensor 122 includes, e.g., the Acoustic Ranger 5000, which is available from Phoenix Inspection Systems, Ltd. located in Warrington, United Kingdom.

The data sensors, processing and communication of various control and monitor units herein may employ similar components and configurations to, e.g., those of the ZONER™ RFID devices and/or the RELAYER™ RFID readers and communication relays, and similar devices, as described in U.S. patent application Ser. No. 11/198,711 filed Aug. 5, 2005 and entitled "Object Monitoring, Locating and Tracking Device Employing Active RFID Devices" which issued as U.S. Pat. No. 7,319,397, and may be operated similarly to the devices described in U.S. patent application Ser. No. 11/749,996 filed May 5, 2007 and entitled "System and Method for Operating a Synchronized Wireless Network" which issued as U.S. Pat. No. 8,174,383, each of which is hereby incorporated herein by reference in its entirety for any and all purposes.

A method for positive train control of a train 50 movable on a track way 60 may comprise: embedding in the track way 60 or having embedded in the track way 60 a plurality of RFID devices 500, the RFID devices 500 being embedded below grade in the track way at least at boundaries between blocks of the track way, and each embedded RFID device having stored therein data including a unique identifier, location data including the geographic location on the track way whereat the embedded RFID device is embedded, or both the unique identifier and the location data, wherein the unique identifier is associated with the geographic location along the track way whereat the embedded RFID device is embedded; providing or obtaining a positive train control unit 100 for mounting on a train operating on the track way wherein each train has a unique train identifier and is authorized to operate in accordance with a train routing order, the positive train control unit 100 performing the steps of: detecting and reading the unique identifier and/or the location data stored in ones of the RFID devices 500 embedded in the track way when the train is proximate each particular one of the embedded RFID devices 500; transmitting the unique identifier and/or the location data received from the embedded RFID devices 500 and a unique train identifier, and/or determining from the location data and/or from the unique identifier received from the embedded RFID devices 500 whether the train is at a geographic location consistent with a train routing order for that train, or both; and providing or obtaining a central facility 70 performing the steps of: receiving transmissions including location data and unique train identifiers from one or more trains operating on the track way and transmitting to the one or more trains operating on the track way; processing the received data to determine whether each of the one or more trains is operating at a location and at a time consistent with a respective train routing order for that train; generating a message, alert and/or warning for a particular train when the location and/or time for the particular train is not consistent with the train routing order for the particular train and transmitting the message, alert and/or warning to the particular train; the particular train receiving the message, alert and/or warning transmitted by the central facility 70 and responding to the message, alert and/or warning for the particular train by providing the message, alert and/or warning in human perceivable form via an operator alert device 210. The detecting and reading the unique identifier and/or the location data stored in ones of the RFID devices 500 embedded in the track way may include detecting and reading the unique identifier and/or the location data stored in plural independent RFID devices 500 embedded in the track way proximate each other at a particular location, each of the plural independent RFID devices 500 having a unique identifier stored therein that is associated with the particular location and each of the plural independent RFID devices 500 at the particular location having the same location data for the particular location stored therein, whereby a train at or passing the particular location detects and reads the unique identifier and/or the location data stored in at least one of the plural independent RFID devices 500 embedded at the particular location. The positive train control method may further comprise comparing for consistency at least the location data stored in each of the plural independent RFID devices 500 embedded at the particular location and/or the location data associated with the unique identifier thereof as read, and when the location data is not consistent, then generating a message, alert and/or warning and: causing the operator alert device to provide the message, alert and/or warning in human perceivable form; or causing the communication device to transmit the message, alert and/or warning to the central facility 70; or causing the operator alert device to provide the message, alert and/or warning and causing the communication device to transmit the message, alert and/or warning to the central facility 70. The positive train control method may further comprise communicating a control signal to a train control on the train to at least adjust the speed of the train when the message, alert and/or warning is generated. The positive train control method may further comprise causing the train control to reduce the speed of the train and/or to stop the train in accordance with a predetermined speed reduction profile or with a predetermined safe emergency speed reduction profile, or both, in response to the control signal. The location data is not consistent when: the location data as read from each of the plural independent RFID devices 500 embedded at the particular location are not consistent with each other; or the location data as read from each of the plural independent RFID devices 500 embedded at the particular location are not consistent with the train routing order; or the location data as read from each of the plural independent RFID devices 500 embedded at the particular location are not consistent with each other and are not consistent with the train routing order. The location data is not consistent when: the location data associated with the unique identifier as read from each of the plural independent RFID devices 500 embedded at the particular location are not consistent with each other; or the location data associated with the unique identifier as read from each of the plural independent RFID devices 500 embedded at the particular location are not consistent with the train routing order; or the location data associated with the unique identifier as read from each of the plural independent RFID devices 500 embedded at the particular location are not consistent with each other and are not consistent with the train routing order. The positive train control method may further comprise transmitting at least the location data stored in each of the plural independent RFID devices 500 embedded at the particular location as read to the central facility 70, the central facility 70 comparing the location data as read for consistency, and when the compared location data is not consistent, then the central facility 70 generating a message, alert and/or warning and transmitting the message, alert and/or warning to the train. The positive train control method of claim 8 may include the train receiving the message, alert and/or warning transmitted by the central facility 70 and the train causing the operator alert device to provide the message, alert and/or warning. The positive train control method may further comprise communicating a control signal to a train control to at least adjust the speed of the train when the message, alert and/or warning is generated. The positive train control method may further comprise causing the train control to reduce the speed of the train and/or to stop the train in accordance with a predetermined speed reduction profile or with a predetermined safe emergency speed reduction profile, or both in response to the control signal. The positive train control method may further comprise modifying the train routing order and directing the train to a siding or to a different track in accordance with the modified train routing order. The detecting and reading the unique identifier and location data stored in ones of the RFID devices 500 embedded in the track way at a particular location may include detecting and reading the unique identifier and location data by plural independent RFID reader/detectors 124, whereby plural independent readings are obtained of the unique identifier and location data stored in a one of the plural RFID devices 500 embedded at the particular location. The positive train control method may further comprise comparing for consistency at least the location data and/or the location data associated with the unique identifier obtained in the plural independent readings, and when the location data is not consistent, then generating a message, alert and/or warning and: causing the operator alert device to provide the message, alert and/or warning in human perceivable form; or causing the communication device to transmit the message, alert and/or warning to the central facility 70; or causing the operator alert device to provide the message, alert and/or warning and causes the communication device to transmit the message, alert and/or warning to the central facility 70. The positive train control method may further comprise communicating a control signal to a train control on the train to at least adjust the speed of the train when the message, alert and/or warning is generated. The positive train control method may further comprise causing the train control to reduce the speed of the train and/or to stop the train in accordance with a predetermined speed reduction profile or with a predetermined safe emergency speed reduction profile, or both in response to the control signal. The positive train control method may further comprise modifying the train routing order and directing the train to a siding or to a different track in accordance with the modified train routing order. The location data is not consistent when: the location data as read by each of the plural independent RFID reader/ detectors 124 are not consistent with each other; or the location data as read by each of the plural independent RFID reader/detectors 124 are not consistent with the train routing order; or the location data associated with the unique identifier as read by each of the plural independent RFID reader/detectors 124 are not consistent with each other; or the location data associated with the unique identifier as read by each of the plural independent RFID reader/detectors 124 are not consistent with the train routing order; or any combination of the foregoing. The positive train control method may further comprise transmitting at least the location data obtained in the plural independent readings to the central facility 70, comparing the location data obtained in the plural independent readings for consistency, and when the location data of the plural independent readings are not consistent, then generating a message, alert and/or warning and transmitting the message, alert and/or warning to the train. The positive train control method may further comprise receiving the transmitted message, alert and/or warning transmitted on the train and causing the operator alert device to provide the message, alert and/or warning. The positive train control method may further comprise communicating a control signal to a train control on the train to at least adjust the speed of the train in response to the received message, alert and/or warning. The positive train control method may further comprise causing the train control to reduce the speed of the train and/or to stop the train in accordance with a predetermined speed reduction profile or with a predetermined safe emergency speed reduction profile, or both in response to the control signal. The positive train control method may further comprise modifying the train routing order and directing the train to a siding or to a different track in accordance with the modified train routing order. The positive train control method may further comprise: receiving image data from an imager and/or a visual imager having a field of view along the track way forward of the train to provide image data representative thereof, and: processing the image data from the imager and/or visual imager; or transmitting the image data from the imager and/or visual imager; or processing the image data from the imager and/or visual imager and transmitting the image data from the imager and/or visual imager. The positive train control method may further comprise: processing the image data from the imager and/or visual imager to determine whether there is an anomaly in the track way and when there is an anomaly in the track way, generating a message, alert and/or warning, causing the operator alert device to provide the message, alert and/or warning, and transmitting the message, alert and/or warning; and/or processing the image data from the imager and/or visual imager at the central facility 70 to determine whether there is an anomaly in the track way and when there is an anomaly in the track way, generating a message, alert and/or warning at the central facility 70 and transmitting the message, alert and/or warning from the central facility 70. The positive train control method may further comprise communicating a control signal to a train control on the train to at least adjust the speed of the train in response to the message, alert and/or warning. The positive train control method may further comprise causing the train control to reduce the speed of the train and/or to stop the train in accordance with a predetermined speed reduction profile or with a predetermined safe emergency speed reduction profile, or both in response to the control signal. The positive train control method may further comprise modifying the train routing order and directing the train to a siding or to a different track in accordance with the modified train routing order. The positive train control method may further comprise receiving the message, alert and/or warning transmitted by the central facility 70 and causing the operator alert device to provide the message, alert and/or warning. The positive train control method may further comprise communicating a control signal to a train control on the train to at least adjust the speed of the train in response to the message, alert and/or warning. The positive train control method may further comprise causing the train control to reduce the speed of the train and/or to stop the train in accordance with a predetermined speed reduction profile or with a predetermined safe emergency speed reduction profile, or both in response to the control signal. The positive train control method may further comprise: geo-tagging the image data from the imager and/or visual imager with location data for the location at which the image data was received; or date-time stamping the image data from the imager and/or visual imager with time data and date data for a date and time at which the image data was received; or geo-tagging and date-time stamping the image data from the imager and/or visual imager with location data, time data and date data for the location, date and time at which the image data was received. The communicating may be via any one or more of a cellular communication system, a cellular base-station and repeater system, a GSM cellular system, a GPRS cellular system, a wireless communication, radio communication, a broadband link, another wireless and/or cellular system, the Internet and/or another network, a radio communication system, a direct radio communication, a wired and/or fiber device, a 220 MHz communication device, an 868 MHz radio system, a 900 MHz communication device, a WiFi network, an ad hoc network, bluetooth, RFID devices, a radio network, one or more repeaters and/or relays, one or more land lines and/or optical fibers, satellite links, Internet connections, LAN networks, WAN networks, or a combination of any or all of the foregoing.

A positive train control system for a train 50 movable on a track way 60 may comprise: a plurality of RFID devices 500 embedded in the track way below grade, the RFID devices 500 being embedded at least at boundaries between blocks of the track way, and each the embedded RFID device having stored therein data including a unique identifier, location data including the geographic location on the track way whereat the embedded RFID device is embedded, or both the unique identifier and the location data, wherein the unique identifier is associated with the geographic location on the track way whereat the embedded RFID device is embedded; a positive train control unit mounted on a train operating on the track way wherein each train has a unique train identifier and is authorized to operate in accordance with a train routing order, the positive train control unit may include: an RFID reader/detector mounted on the train, the RFID reader/detector may include an antenna mounted in a location on the train for detecting and reading the unique identifier and location data stored in ones of the RFID devices 500 embedded in the track way when the train is proximate each particular one of the embedded RFID devices 500; a communication device for transmitting and/or receiving data; a processor on the train for determining from the unique identifier and/or from the location data received from the embedded RFID devices 500 whether the train is at a geographic location consistent with a train routing order for that train, or for causing the unique identifier and/or the location data received from the embedded RFID devices 500 to be transmitted by the communication device, or both; an operator alert device 210 coupled to the processor 120 for providing messages, alerts and warnings in a human perceivable form; and a central facility 70 may include: a central facility communication system for receiving transmissions from one or more trains operating on the track way and for transmitting to the one or more trains operating on the track way; one or more servers for receiving unique identifiers, location data and unique train identifiers received by the central facility communication system in transmissions from the one or more trains operating on the track way, and for processing the received data to determine whether each of the one or more trains is operating at a location and at a time consistent with a respective train routing order for that train; wherein the one or more servers generate a message, alert and/or warning for a particular train when the location and/or time for the particular train is not consistent with the train routing order for the particular train and wherein the central facility communication system transmits the message, alert and/or warning to the particular train; wherein the communication device on the particular train receives the message, alert and/or warning for the particular train transmitted by the central facility communication system and the processor on the particular train responds to the message, alert and/or warning for the particular train by providing the message, alert and/or warning in human perceivable form via the operator alert device. The positive train control system wherein one or more of the plurality of RFID devices 500 embedded in the track way may include plural independent RFID devices 500 embedded in the track way proximate each other at a particular location, each of the plural independent RFID devices 500 having a unique identifier stored therein and each of the plural independent RFID devices 500 at the particular location having the same location data for the particular location stored therein, whereby the RFID reader/detector on a train at or passing the particular location detects and reads the unique identifier and location data stored in at least one of the plural independent RFID devices 500 embedded at the particular location. The processor on the train may compare for consistency at least the location data stored in each of the plural independent RFID devices 500 embedded at the particular location and/or the location data associated with the unique identifier thereof as read by the RFID reader/detector, and when the location data is not consistent, then the processor on the train generates a message, alert and/or warning and: causes the operator alert device to provide the message, alert and/or warning in human perceivable form; or causes the communication device to transmit the message, alert and/or warning to the central facility 70; or causes the operator alert device to provide the message, alert and/or warning and causes the communication device to transmit the message, alert and/or warning to the central facility 70. The positive train control system wherein the train 50 may include a train control 220 and wherein the processor on the train is coupled to the train control, wherein the processor on the train communicates a control signal to the train control to at least adjust the speed of the train on which the positive train control unit is mounted when the processor generates the message, alert and/or warning. The control signal may cause the train control 220 to reduce the speed of the train and/or to stop the train in accordance with a predetermined speed reduction profile or with a predetermined safe emergency speed reduction profile, or both. The location data is not consistent when: the location data as read from each of the plural independent RFID devices 500 embedded at the particular location are not consistent with each other; or the location data as read from each of the plural independent RFID devices 500 embedded at the particular location are not consistent with the train routing order; or the location data as read from each of the plural independent RFID devices 500 embedded at the particular location are not consistent with each other and are not consistent with the train routing order. The location data is not consistent when: the location data associated with the unique identifier as read from each of the plural independent RFID devices 500 embedded at the particular location are not consistent with each other; or the location data associated with the unique identifier as read from each of the plural independent RFID devices 500 embedded at the particular location are not consistent with the train routing order; or the location data associated with the unique identifier as read from each of the plural independent RFID devices 500 embedded at the particular location are not consistent with each other and are not consistent with the train routing order. The communication device on the train may transmit at least the location data stored in each of the plural independent RFID devices 500 embedded at the particular location as read by the RFID reader/detector to the central facility 70, wherein the one or more servers of the central facility 70 may compare the location data as read by the RFID reader/detector for consistency, and when the compared location data is not consistent, then the one or more servers processor generates a message, alert and/or warning and the central facility communication system transmits the message, alert and/or warning to the train. The communication device on the train receives the message, alert and/or warning transmitted by the central facility communication system and the processor on the train causes the operator alert device to provide the message, alert and/or warning. The train may include a train control 220 and wherein the processor on the train is coupled to the train control, wherein the processor on the train communicates a control signal to the train control to at least adjust the speed of the train on which the positive train control unit is mounted when the processor generates the message, alert and/or warning. The control signal may cause the train control 220 to reduce the speed of the train and/or to stop the train in accordance with a predetermined speed reduction profile or with a predetermined safe emergency speed reduction profile, or both. The RFID reader/detector 124 may include plural independent RFID reader/detectors 124, each of the plural independent RFID reader/detectors 124 may include an antenna mounted on the train in a location for detecting and reading the unique identifier and location data stored in the embedded RFID devices 500, whereby the plural independent RFID reader/detectors 124 on a train at or passing a particular location detect and read the unique identifier and location data stored in a one of the plural RFID devices 500 embedded at the particular location. The processor 120 on the train may compare for consistency at least the location data stored in each of the RFID devices 500 embedded at the particular location as read by each of the plural independent RFID reader/detectors 124 and/or the location data associated with the unique identifier as read by each of the plural independent RFID reader/detectors 124, and when the location data is not consistent, then the processor 120 on the train generates a message, alert and/or warning and: causes the operator alert device 210 to provide the message, alert and/or warning in human perceivable form; or causes the communication device to transmit the message, alert and/or warning to the central facility 70; or causes the operator alert device to provide the message, alert and/or warning and causes the communication device to transmit the message, alert and/or warning to the central facility 70. The train may include a train control 220 and wherein the processor 120 on the train is coupled to the train control, wherein the processor on the train communicates a control signal to the train control to at least adjust the speed of the train on which the positive train control unit is mounted when the processor generates the message, alert and/or warning. The control signal may cause the train control 220 to reduce the speed of the train and/or to stop the train in accordance with a predetermined speed reduction profile or with a predetermined safe emergency speed reduction profile, or both. The location data is not consistent when: the location data as read by each of the plural independent RFID reader/detectors 124 are not consistent with each other; or the location data as read by each of the plural independent RFID reader/detectors 124 are not consistent with the train routing order; or the location data associated with the unique identifier as read by each of the plural independent RFID reader/detectors 124 are not consistent with each other; or the location data associated with the unique identifier as read by each of the plural independent RFID reader/detectors 124 are not consistent with the train routing order; or any combination of the foregoing. The communication device on the train may transmit at least the location data stored in each of the plural independent RFID devices 500 embedded at the particular location as read by each of the plural independent RFID reader/detectors 124 to the central facility 70, wherein the one or more servers of the central facility 70 may compare the location data as read by the plural independent RFID reader/detectors 124 for consistency, and when the compared location data is not consistent, then the one or more servers processor generates a message, alert and/or warning and the central facility communication system transmits the message, alert and/or warning to the train. The communication device on the train receives the message, alert and/or warning transmitted by the central facility communication system and the processor on the train causes the operator alert device to provide the message, alert and/or warning. The train may include a train control 220 and the processor on the train may be coupled to the train control, wherein the processor on the train communicates a control signal to the train control to at least adjust the speed of the train on which the positive train control unit is mounted when the processor generates the message, alert and/or warning. The control signal may cause the train control to reduce the speed of the train and/or to stop the train in accordance with a predetermined speed reduction profile or with a predetermined safe emergency speed reduction profile, or both. The positive train control unit may further include an imager and/or a visual imager having a field of view along the track way forward of the train to provide image data representative thereof, wherein: the processor processes image data from the imager and/or visual imager; or the communication device transmits the image data from the imager and/or visual imager; or the processor processes image data from the imager and/or visual imager and the communication device transmits the image data from the imager and/or visual imager. The positive train control system wherein: the processor processes the image data from the imager and/or visual imager to determine whether there is an anomaly in the track way and when there is an anomaly in the track way, the processor generates a message, alert and/or warning and causes the operator alert device to provide the message, alert and/or warning and causes the communication device to transmit the communication device to transmit the message, alert and/or warning; and/or the central facility communication system receives the transmitted message, alert and/or warning and the one or more servers processes the received image data from the visual imager to determine whether there is an anomaly in the track way and when there is an anomaly in the track way, the one or more servers generates a message, alert and/or warning and causes the central facility communication system to transmit the message, alert and/or warning. The train may include a train control 220 and the processor on the train may be coupled to the train control, wherein the processor on the train communicates a control signal to the train control to at least adjust the speed of the train on which the positive train control unit is mounted when the processor generates the message, alert and/or warning. The control signal may cause the train control to reduce the speed of the train and/or to stop the train in accordance with a predetermined speed reduction profile or with a predetermined safe emergency speed reduction profile, or both. The communication device on the train receives the message, alert and/or warning transmitted by the central facility communication system and the processor on the train causes the operator alert device to provide the message, alert and/or warning. The train may include a train control 220 and the processor on the train may be coupled to the train control, wherein the processor on the train communicates a control signal to the train control to at least adjust the speed of the train on which the positive train control unit is mounted when the processor generates the message, alert and/or warning. The control signal may cause the train control to reduce the speed of the train and/or to stop the train in accordance with a predetermined speed reduction profile or with a predetermined safe emergency speed reduction profile, or both. The communication device, the central facility communication system, or the communication device and the central facility communication system, communicate via any one or more of a cellular communication system, a cellular base-station and repeater system, a GSM cellular system, a GPRS cellular system, a wireless communication, radio communication, a broadband link, another wireless and/or cellular system, the Internet and/or another network, a radio communication system, a direct radio communication, a wired and/or fiber device, a 220 MHz communication device, an 868 MHz radio system, a 900 MHz communication device, a WiFi network, an ad hoc network, bluetooth, RFID devices, a radio network, one or more repeaters and/or relays, one or more land lines and/or optical fibers, satellite links, Internet connections, LAN networks, WAN networks, or a combination of any or all of the foregoing.

As used herein, the term "about" means that dimensions, sizes, formulations, parameters, shapes and other quantities and characteristics are not and need not be exact, but may be approximate and/or larger or smaller, as desired, reflecting tolerances, conversion factors, rounding off, measurement error and the like, and other factors known to those of skill in the art. In general, a dimension, size, formulation, parameter, shape or other quantity or characteristic is "about" or "approximate" whether or not expressly stated to be such. It is noted that embodiments of very different sizes, shapes and dimensions may employ the described arrangements.

As used herein a "train" is intended to include any vehicle or vehicles that are movable on or along a "track" or "track way," irrespective of the length of the "track way," including but not limited to, a railroad train of one or more carriages and/or one or more locomotive units, whether integral to one or more carriages or separate therefrom, and irrespective of the service engaged in whether long distance, regional, local and/or commuter, passenger and/or freight, and the like. Train also includes tracked and trackless trolleys, monorail vehicles, light rail vehicles, magnetically levitated vehicles, motor vehicles, cars, trucks, autonomous vehicles, and any other similar vehicles, irrespective of the number of units or cars thereof, and irrespective of whether a unit may be self propelled or require a locomotive or engine. A train may be operated autonomously, with or without human backup, or by an engineer or other on-board operator, or by an operator or other controller located remotely from the train, or by any combination thereof.

As used herein, a "track" or "track way" is intended to include any way or structure that guides or otherwise limits the degrees of freedom of the travel of a "train" thereon, including but not limited to, a track, a railway whether of one or two or more rails, railways of standard, narrow or any other gauge, a guide and/or guideway, an electrically controlled guideway, a magnetically levitated guide and/or guideway, a road and/or roadway, an electrically controlled road and/or roadway, a monorail, a canal, a channel, a right of way, and the right of way therefor, and the like. Typically, a "track" or "track way" limits or is intended to limit movement of a train substantially to one dimension, e.g., forward and backward, although there may be limited permitted movement in another dimension, e.g., side-to-side and/or up-and-down. A "track way" is usually referred to herein simply as a "track," and the terms are considered to be substantially equivalent and interchangeable.

As used herein, "positive train control unit" refers to one or more physical units or modules that contain any one or more of the various sensors, RFID readers, RFID detectors, and other equipment thereof as described herein, or to the various sensors, RFID readers, RFID detectors, and other equipment described herein when connected so as to be operable as a positive train control unit as described herein. A collection of connected sensors and other equipment integrated into a train, e.g., into an engine or locomotive therefor, or carried by a train, is considered to be a positive train control unit when connected so as to be operable as a positive train control unit as described herein.

As used herein, an "anomaly" of a rail and/or of a track way includes any condition where the track way is not within proper operating condition, including but not limited to, the physical spacing and/or alignment and/or completeness of a transfer of a switch rail of a track way not being within a prescribed configuration and/or tolerances, and/or the physical spacing and/or alignment of a track way and/or of the rails of a track way not being within a prescribed configuration and or alignment and/or tolerances, and/or where there is any obstacle or object in and/or near to the track way.

GPS is used herein to refer to any system for the determination of geographic location including but not limited to the United States' Global Positioning System and its satellite constellation as well as to any other radio communication based geographical position or location determining and/or navigation systems and aids, including but not limited to the Russian Glonass, the Galileo, the IRNSS and/or the BEIDOU-2 systems.

An RFID reader/detector typically detects the presence of an RFID device 500 and reads (acquires) the data stored therein, e.g., by signaling the RFID device to transmit data stored therein and receiving, acquiring and/or capturing that data. The terms reader, detector and reader/detector are used interchangeably herein. The RFID device may be passive, e.g., it awaits a stimulating or interrogating signal from a reader/detector before transmitting its stored data, or it may be active, e.g., it periodically transmits the data stored therein without having been stimulated or interrogated. The stimulation and/or interrogation of an RFID device may be provided by a signal transmitted by an RFID reader/detector.

Although terms such as "up," "down," "left," "right," "up," "down," "front," "rear," "side," "end," "top," "bottom," "forward," "backward," "under" and/or "over," "vertical," "horizontal," and the like may be used herein as a convenience in describing one or more embodiments and/or uses of the present arrangement, the articles described may be positioned in any desired orientation and/or may be utilized in any desired position and/or orientation. Such terms of position and/or orientation should be understood as being for convenience only, and not as limiting of the invention as claimed.

Further, what is stated as being "optimum" or "deemed optimum" may or may not be a true optimum condition, but is the condition deemed to be desirable or acceptably "optimum" by virtue of its being selected in accordance with the decision rules and/or criteria defined by the designer and/or applicable controlling function, e.g., the moving block limitation may be adjusted dynamically depending upon weather and other conditions that may affect visibility, precipitation and other wetness that may affect braking ability and/or stopping distances, and any other condition or conditions that may affect operation so as to make dynamic adjustment of the moving block desirable under such condition or conditions.

The term battery is used herein to refer to an electrochemical device comprising one or more electro-chemical cells and/or fuel cells, and so a battery may include a single cell or plural cells, whether as individual units or as a packaged unit. A battery is one example of a type of an electrical power source suitable for a portable device. Other devices could include fuel cells, super capacitors, solar cells, and the like. Any of the foregoing may be intended for a single use or for being rechargeable or for both.

While the present invention has been described in terms of the foregoing example embodiments, variations within the scope and spirit of the present invention as defined by the claims following will be apparent to those skilled in the art. For example, while in the described examples three is a preferred number of RFID control devices 500 that are employed at or near a block boundary 82, a greater or lesser number of devices 500, including a single device 500, may be employed. Similarly, while in the described examples two is a preferred number of RFID reader/detectors 124 carried with a positive train control unit 100, a greater or lesser number of RFID reader/detectors 124, including a single RFID reader/detector 124, may be employed.

The number and/or types of sensors 110, 312 of a positive train control unit 100 and/or of a wayside unit 310 may be augmented in applications wherein there is a need for an additional sensor and/or may be reduced in applications wherein there is no need for a particular sensor. It is sufficient in the present arrangement that one or more RFID readers and/or detectors be provided in a positive train control unit 100.

Further, while RFID devices 500 are described as being located at boundaries 82 between blocks 80, additional RFID devices 500 may be provided within a block 80 where it is desired that the location of trains 50 within a block 80 be more closely monitored, e.g., where a block 80 is relatively longer than a typical block 80 or where the cargo moving through a particular block is of a nature that closer monitoring is desired.

Similarly, the types and kinds of communications equipment 140, 160, 3140, 3160 that may be provided may be augmented and/or reduced consistent with the needs and desires applicable to a particular application. For example, if a wayside monitor 310 or switch monitor 320 or track monitor 330 were to be located in a remote location, e.g., far away from other electronic equipment, then only longer range communication devices need be provided.

Instructions, messages, alerts and warnings to an operator of a train 50 may be displayed on a computer monitor, a laptop computer, a tablet computer, a smart phone or any other suitable device and may provide visual and/or audible instructions, alerts and warnings, e.g., a flashing, pulsing or strobe light or display, and/or a text, iconic or other indication, and/or a buzzing, siren-like or other audible signal. Optionally, the operator may be required to acknowledge receipt of and/or having responded to the instruction, alert or warning by following a handshake procedure, e.g., pressing a button (a physical button or an iconic button displayed on a monitor screen) of any of the foregoing devices.

Preferably, the current location of the train 50, e.g., the block and track location thereof, is displayed on the operator alert device 210 essentially in "real time" as location data and/or the unique identifier with which location data is associated is read from embedded RFID devices 500, and any deviation from the train routing order may be detected by processor 120 to generate an alert and/or warning that is also displayed and/or audibly signaled.

Each of the U.S. Provisional applications, U.S. patent applications, and/or U.S. patents, identified herein is hereby incorporated herein by reference in its entirety, for any purpose and for all purposes irrespective of how it may be referred to or described herein.

Finally, numerical values stated are typical or example values, are not limiting values, and do not preclude substantially larger and/or substantially smaller values. Values in any given embodiment may be substantially larger and/or may be substantially smaller than the example or typical values stated.

What is claimed is:

1. A method for positive train control of a train movable on a track way comprising:

embedding in the track way or having embedded in the track way a plurality of RFID devices, the RFID devices being embedded below grade in the track way at least at boundaries between blocks of the track way, and each embedded RFID device having stored therein data including a unique identifier, location data including the geographic location on the track way whereat the embedded RFID device is embedded, or both the unique identifier and the location data, wherein the unique identifier is associated with the geographic location along the track way whereat the embedded RFID device is embedded;

providing or obtaining a positive train control unit for mounting on a train operating on the track way wherein each train has a unique train identifier and is authorized to operate in accordance with a train routing order, the positive train control unit performing the steps of:

detecting and reading the unique identifier and/or the location data stored in ones of the RFID devices embedded in the track way when the train is proximate each particular one of the embedded RFID devices;

transmitting the unique identifier and/or the location data received from the embedded RFID devices and a unique train identifier, and/or determining from the location data and/or from the unique identifier received from the embedded RFID devices whether the train is at a geographic location consistent with a train routing order for that train, or both; and providing or obtaining a central facility performing the steps of:

receiving transmissions including location data and unique train identifiers from one or more trains operating on the track way and transmitting to the one or more trains operating on the track way;

processing the received data to determine whether each of the one or more trains is operating at a location and at a time consistent with a respective train routing order for that train;

generating a message, alert and/or warning for a particular train when the location and/or time for the particular train is not consistent with the train routing order for the particular train and transmitting the message, alert and/or warning to the particular train;

the particular train receiving the message, alert and/or warning transmitted by the central facility and responding to the message, alert and/or warning for the particular train by providing the message, alert and/or warning in human perceivable form via an operator alert device.

2. The positive train control method of claim 1 wherein said detecting and reading the unique identifier and/or the location data stored in ones of the RFID devices embedded in the track way includes detecting and reading the unique identifier and/or the location data stored in plural independent RFID devices embedded in the track way proximate each other at a particular location, each of the plural independent RFID devices having a unique identifier stored therein that is associated with the particular location and each of the plural independent RFID devices at the particular location having the same location data for the particular location stored therein, whereby a train at or passing the particular location detects and reads the unique identifier and/or the location data stored in at least one of the plural independent RFID devices embedded at the particular location.

3. The positive train control method of claim 2 further comprising comparing for consistency at least the location data stored in each of the plural independent RFID devices embedded at the particular location and/or the location data associated with the unique identifier thereof as read, and when the location data is not consistent, then generating a message, alert and/or warning and:

causing the operator alert device to provide the message, alert and/or warning in human perceivable form; or causing the communication device to transmit the message, alert and/or warning to the central facility; or causing the operator alert device to provide the message, alert and/or warning and causing the communication device to transmit the message, alert and/or warning to the central facility.

4. The positive train control method of claim 3 further comprising communicating a control signal to a train control on the train to at least adjust the speed of the train when the message, alert and/or warning is generated.

5. The positive train control method of claim 4 further comprising causing the train control to reduce the speed of the train and/or to stop the train in accordance with a predetermined speed reduction profile or with a predetermined safe emergency speed reduction profile, or both, in response to the control signal.

6. The positive train control method of claim 3 wherein the location data is not consistent when:

the location data as read from each of the plural independent RFID devices embedded at the particular location are not consistent with each other; or the location data as read from each of the plural independent RFID devices embedded at the particular location are not consistent with the train routing order; or the location data as read from each of the plural independent RFID devices embedded at the particular location are not consistent with each other and are not consistent with the train routing order.

7. The positive train control method of claim 3 wherein the location data is not consistent when:

the location data associated with the unique identifier as read from each of the plural independent RFID devices embedded at the particular location are not consistent with each other; or the location data associated with the unique identifier as read from each of the plural independent RFID devices embedded at the particular location are not consistent with the train routing order; or the location data associated with the unique identifier as read from each of the plural independent RFID devices embedded at the particular location are not consistent with each other and are not consistent with the train routing order.

8. The positive train control method of claim 2 further comprising transmitting at least the location data stored in each of the plural independent RFID devices embedded at the particular location as read to the central facility, the central facility comparing the location data as read for consistency, and when the compared location data is not consistent, then the central facility generating a message, alert and/or warning and transmitting the message, alert and/or warning to the train.

9. The positive train control method of claim 8 including the train receiving the message, alert and/or warning transmitted by the central facility and the train causing the operator alert device to provide the message, alert and/or warning.

10. The positive train control method of claim 9 further comprising communicating a control signal to a train control to at least adjust the speed of the train when the message, alert and/or warning is generated.

11. The positive train control method of claim 10 further comprising causing the train control to reduce the speed of the train and/or to stop the train in accordance with a predetermined speed reduction profile or with a predetermined safe emergency speed reduction profile, or both in response to the control signal.

12. The positive train control method of claim 8 further comprising modifying the train routing order and directing the train to a siding or to a different track in accordance with the modified train routing order.

13. The positive train control method of claim 1 wherein said detecting and reading the unique identifier and location data stored in ones of the RFID devices embedded in the track way at a particular location includes detecting and reading the unique identifier and location data by plural independent RFID reader/detectors, whereby plural independent readings are obtained of the unique identifier and location data stored in a one of the plural RFID devices embedded at the particular location.

14. The positive train control method of claim 13 further comprising comparing for consistency at least the location data and/or the location data associated with the unique identifier obtained in the plural independent readings, and when the location data is not consistent, then generating a message, alert and/or warning and:

causing the operator alert device to provide the message, alert and/or warning in human perceivable form; or causing the communication device to transmit the message, alert and/or warning to the central facility; or causing the operator alert device to provide the message, alert and/or warning and causes said communication device to transmit the message, alert and/or warning to the central facility.

15. The positive train control method of claim 14 further comprising communicating a control signal to a train control on the train to at least adjust the speed of the train when the message, alert and/or warning is generated.

16. The positive train control method of claim 15 further comprising causing the train control to reduce the speed of the train and/or to stop the train in accordance with a predetermined speed reduction profile or with a predetermined safe emergency speed reduction profile, or both in response to the control signal.

17. The positive train control method of claim 13 further comprising modifying the train routing order and directing the train to a siding or to a different track in accordance with the modified train routing order.

18. The positive train control method of claim 17 further comprising modifying the train routing order and directing the train to a siding or to a different track in accordance with the modified train routing order.

19. The positive train control method of claim 14 wherein the location data is not consistent when:

the location data as read by each of said plural independent RFID reader/detectors are not consistent with each other; or the location data as read by each of said plural independent RFID reader/detectors are not consistent with the train routing order; or the location data associated with the unique identifier as read by each of said plural independent RFID reader/detectors are not consistent with each other; or the location data associated with the unique identifier as read by each of said plural independent RFID reader/detectors are not consistent with the train routing order; or any combination of the foregoing.

20. The positive train control method of claim 13 further comprising transmitting at least the location data obtained in the plural independent readings to the central facility, comparing the location data obtained in the plural independent readings for consistency, and when the location data of the plural independent readings are not consistent, then generating a message, alert and/or warning and transmitting the message, alert and/or warning to the train.

21. The positive train control method of claim 20 further comprising receiving the transmitted message, alert and/or warning transmitted on the train and causing the operator alert device to provide the message, alert and/or warning.

22. The positive train control method of claim 21 further comprising communicating a control signal to a train control on the train to at least adjust the speed of the train in response to the received message, alert and/or warning.

23. The positive train control method of claim 22 further comprising causing the train control to reduce the speed of the train and/or to stop the train in accordance with a predetermined speed reduction profile or with a predetermined safe emergency speed reduction profile, or both in response to the control signal.

24. The positive train control method of claim 1 further comprising:

receiving image data from an imager and/or a visual imager having a field of view along the track way forward of the train to provide image data representative thereof, and:

processing the image data from the imager and/or visual imager; or transmitting the image data from the imager and/or visual imager; or processing the image data from the imager and/or visual imager and transmitting the image data from the imager and/or visual imager.

25. The positive train control method of claim 24 further comprising:

processing the image data from the imager and/or visual imager to determine whether there is an anomaly in the track way and when there is an anomaly in the track way, generating a message, alert and/or warning, causing the operator alert device to provide the message, alert and/or warning, and transmitting the message, alert and/or warning; and/or processing the image data from the imager and/or visual imager at the central facility to determine whether there is an anomaly in the track way and when there is an anomaly in the track way, generating a message, alert and/or warning at the central facility and transmitting the message, alert and/or warning from the central facility.

26. The positive train control method of claim 25 further comprising communicating a control signal to a train control on the train to at least adjust the speed of the train in response to the message, alert and/or warning.

27. The positive train control method of claim 26 further comprising causing the train control to reduce the speed of the train and/or to stop the train in accordance with a predetermined speed reduction profile or with a predetermined safe emergency speed reduction profile, or both in response to the control signal.

28. The positive train control method of claim 25 further comprising modifying the train routing order and directing the train to a siding or to a different track in accordance with the modified train routing order.

29. The positive train control method of claim 25 further comprising receiving the message, alert and/or warning transmitted by the central facility and causing the operator alert device to provide the message, alert and/or warning.

30. The positive train control method of claim 29 further comprising communicating a control signal to a train control on the train to at least adjust the speed of the train in response to the message, alert and/or warning.

31. The positive train control method of claim 30 further comprising causing the train control to reduce the speed of the train and/or to stop the train in accordance with a predetermined speed reduction profile or with a predetermined safe emergency speed reduction profile, or both in response to the control signal.

32. The positive train control method of claim 24 further comprising:

geo-tagging the image data from the imager and/or visual imager with location data for the location at which the image data was received; or date-time stamping the image data from the imager and/or visual imager with time data and date data for a date and time at which the image data was received; or geo-tagging and date-time stamping the image data from the imager and/or visual imager with location data, time data and date data for the location, date and time at which the image data was received.

33. The positive train control method of claim 1 wherein said communicating is via any one or more of a cellular communication system, a cellular base-station and repeater system, a GSM cellular system, a GPRS cellular system, a wireless communication, radio communication, a broadband link, another wireless and/or cellular system, the Internet and/or another network, a radio communication system, a direct radio communication, a wired and/or fiber device, a 220 MHz communication device, an 868 MHz radio system, a 900 MHz communication device, a WiFi network, an ad hoc network, bluetooth, RFID devices, a radio network, one or more repeaters and/or relays, one or more land lines and/or optical fibers, satellite links, Internet connections, LAN networks, WAN networks, or a combination of any or all of the foregoing.

34. A positive train control system for a train movable on a track way comprising:

a plurality of RFID devices embedded in the track way below grade, the RFID devices being embedded at least at boundaries between blocks of the track way, and each said embedded RFID device having stored therein data including a unique identifier, location data including the geographic location on the track way whereat said embedded RFID device is embedded, or both the unique identifier and the location data, wherein the unique identifier is associated with the geographic location on the track way whereat said embedded RFID device is embedded;

a positive train control unit mounted on a train operating on the track way wherein each train has a unique train identifier and is authorized to operate in accordance with a train routing order, said positive train control unit including:

an RFID reader/detector mounted on the train, said RFID reader/detector including an antenna mounted in a location on the train for detecting and reading the unique identifier and location data stored in ones of said RFID devices embedded in the track way when the train is proximate each particular one of said embedded RFID devices;

a communication device for transmitting and/or receiving data;

a processor on the train for determining from the unique identifier and/or from the location data received from the embedded RFID devices whether the train is at a geographic location consistent with a train routing order for that train, or for causing the unique identifier and/or the location data received from the embedded RFID devices to be transmitted by said communication device, or both;

an operator alert device coupled to said processor for providing messages, alerts and warnings in a human perceivable form; and a central facility including:

a central facility communication system for receiving transmissions from one or more trains operating on the track way and for transmitting to the one or more trains operating on the track way;

one or more servers for receiving unique identifiers, location data and unique train identifiers received by the central facility communication system in transmissions from the one or more trains operating on the track way, and for processing the received data to determine whether each of the one or more trains is operating at a location and at a time consistent with a respective train routing order for that train;

wherein said one or more servers generate a message, alert and/or warning for a particular train when the location and/or time for the particular train is not consistent with the train routing order for the particular train and wherein said central facility communication system transmits the message, alert and/or warning to the particular train;

wherein the communication device on the particular train receives the message, alert and/or warning for the particular train transmitted by said central facility communication system and said processor on the particular train responds to the message, alert and/or warning for the particular train by providing the message, alert and/or warning in human perceivable form via said operator alert device.

35. The positive train control system of claim 34 wherein one or more of said plurality of RFID devices embedded in the track way includes plural independent RFID devices embedded in the track way proximate each other at a particular location, each of said plural independent RFID devices having a unique identifier stored therein and each of said plural independent RFID devices at the particular location having the same location data for the particular location stored therein, whereby said RFID reader/detector on a train at or passing the particular location detects and reads the unique identifier and location data stored in at least one of said plural independent RFID devices embedded at the particular location.

36. The positive train control system of claim 35 wherein said processor on the train compares for consistency at least the location data stored in each of said plural independent RFID devices embedded at the particular location and/or the location data associated with the unique identifier thereof as read by said RFID reader/detector, and when the location data is not consistent, then said processor on the train generates a message, alert and/or warning and:

causes said operator alert device to provide the message, alert and/or warning in human perceivable form; or causes said communication device to transmit the message, alert and/or warning to the central facility; or causes said operator alert device to provide the message, alert and/or warning and causes said communication device to transmit the message, alert and/or warning to the central facility.

37. The positive train control system of claim 36 wherein the train includes a train control and wherein said processor on the train is coupled to said train control, wherein said processor on the train communicates a control signal to said train control to at least adjust the speed of the train on which said positive train control unit is mounted when said processor generates the message, alert and/or warning.

38. The positive train control system of claim 37 wherein the control signal causes said train control to reduce the speed of the train and/or to stop the train in accordance with a predetermined speed reduction profile or with a predetermined safe emergency speed reduction profile, or both.

39. The positive train control system of claim 36 wherein the location data is not consistent when:

the location data as read from each of said plural independent RFID devices embedded at the particular location are not consistent with each other; or the location data as read from each of said plural independent RFID devices embedded at the particular location are not consistent with the train routing order; or the location data as read from each of said plural independent RFID devices embedded at the particular location are not consistent with each other and are not consistent with the train routing order.

40. The positive train control system of claim 36 wherein the location data is not consistent when:

the location data associated with the unique identifier as read from each of said plural independent RFID devices embedded at the particular location are not consistent with each other; or the location data associated with the unique identifier as read from each of said plural independent RFID devices embedded at the particular location are not consistent with the train routing order; or the location data associated with the unique identifier as read from each of the plural independent RFID devices embedded at the particular location are not consistent with each other and are not consistent with the train routing order.

41. The positive train control system of claim 35 wherein said communication device on the train transmits at least the location data stored in each of said plural independent RFID devices embedded at the particular location as read by said RFID reader/detector to the central facility, wherein said one or more servers of said central facility compares the location data as read by said RFID reader/detector for consistency, and when the compared location data is not consistent, then said one or more servers processor generates a message, alert and/or warning and said central facility communication system transmits the message, alert and/or warning to the train.

42. The positive train control system of claim 41 wherein said communication device on the train receives the message, alert and/or warning transmitted by said central facility communication system and said processor on the train causes said operator alert device to provide the message, alert and/or warning.

43. The positive train control system of claim 42 wherein the train includes a train control and wherein said processor on the train is coupled to said train control, wherein said processor on the train communicates a control signal to said train control to at least adjust the speed of the train on which said positive train control unit is mounted when said processor generates the message, alert and/or warning.

44. The positive train control system of claim 43 wherein the control signal causes said train control to reduce the speed of the train and/or to stop the train in accordance with a predetermined speed reduction profile or with a predetermined safe emergency speed reduction profile, or both.

45. The positive train control system of claim 34 wherein said RFID reader/detector includes plural independent RFID reader/detectors, each of said plural independent RFID reader/detectors including an antenna mounted on the train in a location for detecting and reading the unique identifier and location data stored in said embedded RFID devices, whereby said plural independent RFID reader/detectors on a train at or passing a particular location detect and read the unique identifier and location data stored in a one of said plural RFID devices embedded at the particular location.

46. The positive train control system of claim 45 wherein said processor on the train compares for consistency at least the location data stored in each of said RFID devices embedded at the particular location as read by each of said plural independent RFID reader/detectors and/or the location data associated with the unique identifier as read by each of said plural independent RFID reader/detectors, and when the location data is not consistent, then said processor on the train generates a message, alert and/or warning and:

causes said operator alert device to provide the message, alert and/or warning in human perceivable form; or causes said communication device to transmit the message, alert and/or warning to the central facility; or causes said operator alert device to provide the message, alert and/or warning and causes said communication device to transmit the message, alert and/or warning to the central facility.

47. The positive train control system of claim 46 wherein the train includes a train control and wherein said processor on the train is coupled to said train control, wherein said processor on the train communicates a control signal to said train control to at least adjust the speed of the train on which said positive train control unit is mounted when said processor generates the message, alert and/or warning.

48. The positive train control system of claim 47 wherein the control signal causes said train control to reduce the speed of the train and/or to stop the train in accordance with a predetermined speed reduction profile or with a predetermined safe emergency speed reduction profile, or both.

49. The positive train control system of claim 46 wherein the location data is not consistent when:

the location data as read by each of said plural independent RFID reader/detectors are not consistent with each other; or the location data as read by each of said plural independent RFID reader/detectors are not consistent with the train routing order; or the location data associated with the unique identifier as read by each of said plural independent RFID reader/detectors are not consistent with each other; or the location data associated with the unique identifier as read by each of said plural independent RFID reader/detectors are not consistent with the train routing order; or any combination of the foregoing.

50. The positive train control system of claim 45 wherein said communication device on the train transmits at least the location data stored in each of said plural independent RFID devices embedded at the particular location as read by each of said plural independent RFID reader/detectors to the central facility, wherein said one or more servers of said central facility compares the location data as read by said plural independent RFID reader/detectors for consistency, and when the compared location data is not consistent, then said one or more servers processor generates a message, alert and/or warning and said central facility communication system transmits the message, alert and/or warning to the train.

51. The positive train control system of claim 50 wherein said communication device on the train receives the message, alert and/or warning transmitted by said central facility communication system and said processor on the train causes said operator alert device to provide the message, alert and/or warning.

52. The positive train control system of claim 51 wherein the train includes a train control and wherein said processor on the train is coupled to said train control, wherein said processor on the train communicates a control signal to said train control to at least adjust the speed of the train on which said positive train control unit is mounted when said processor generates the message, alert and/or warning.

53. The positive train control system of claim 52 wherein the control signal causes said train control to reduce the speed of the train and/or to stop the train in accordance with a predetermined speed reduction profile or with a predetermined safe emergency speed reduction profile, or both.

54. The positive train control system of claim 34 wherein said positive train control unit further includes an imager and/or a visual imager having a field of view along the track way forward of the train to provide image data representative thereof, wherein:

said processor processes image data from said imager and/or visual imager; or said communication device transmits the image data from said imager and/or visual imager; or said processor processes image data from said imager and/or visual imager and said communication device transmits the image data from said imager and/or visual imager.

55. The positive train control system of claim 54 wherein:

said processor processes the image data from said imager and/or visual imager to determine whether there is an anomaly in the track way and when there is an anomaly in the track way, said processor generates a message, alert and/or warning and causes said operator alert device to provide the message, alert and/or warning and causes said communication device to transmit said communication device to transmit the message, alert and/or warning; and/or said central facility communication system receives the transmitted message, alert and/or warning and said one or more servers processes the received image data from said visual imager to determine whether there is an anomaly in the track way and when there is an anomaly in the track way, said one or more servers generates a message, alert and/or warning and causes said central facility communication system to transmit the message, alert and/or warning.

56. The positive train control system of claim 55 wherein the train includes a train control and wherein said processor on the train is coupled to said train control, wherein said processor on the train communicates a control signal to said train control to at least adjust the speed of the train on which said positive train control unit is mounted when said processor generates the message, alert and/or warning.

57. The positive train control system of claim 56 wherein the control signal causes said train control to reduce the speed of the train and/or to stop the train in accordance with a predetermined speed reduction profile or with a predetermined safe emergency speed reduction profile, or both.

58. The positive train control system of claim 55 wherein said communication device on the train receives the message, alert and/or warning transmitted by said central facility communication system and said processor on the train causes said operator alert device to provide the message, alert and/or warning.

59. The positive train control system of claim 58 wherein the train includes a train control and wherein said processor on the train is coupled to said train control, wherein said processor on the train communicates a control signal to said train control to at least adjust the speed of the train on which said positive train control unit is mounted when said processor generates the message, alert and/or warning.

60. The positive train control system of claim 59 wherein the control signal causes said train control to reduce the speed of the train and/or to stop the train in accordance with a predetermined speed reduction profile or with a predetermined safe emergency speed reduction profile, or both.

61. The positive train control system of claim 34 wherein said communication device, said central facility communication system, or said communication device and said central facility communication system, communicate via any one or more of a cellular communication system, a cellular base-station and repeater system, a GSM cellular system, a GPRS cellular system, a wireless communication, radio communication, a broadband link, another wireless and/or cellular system, the Internet and/or another network, a radio communication system, a direct radio communication, a wired and/or fiber device, a 220 MHz communication device, an 868 MHz radio system, a 900 MHz communication device, a WiFi network, an ad hoc network, bluetooth, RFID devices, a radio network, one or more repeaters and/or relays, one or more land lines and/or optical fibers, satellite links, Internet connections, LAN networks, WAN networks, or a combination of any or all of the foregoing.

* * * * *